US012109462B2

(12) United States Patent
Simone et al.

(10) Patent No.: US 12,109,462 B2
(45) **Date of Patent: *Oct. 8, 2024**

(54) GOLF CLUB HEADS HAVING A LOCALIZED HEAT AFFECTED ZONE

(71) Applicant: Karsten Manufacturing Corporation, Phoenix, AZ (US)

(72) Inventors: Matthew W. Simone, Phoenix, AZ (US); Eric J. Morales, Laveen, AZ (US); Ryan M. Stokke, Anthem, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/086,223

(22) Filed: Dec. 21, 2022

(65) Prior Publication Data

US 2023/0131046 A1 Apr. 27, 2023

Related U.S. Application Data

(63) Continuation of application No. 17/020,651, filed on Sep. 14, 2020, now Pat. No. 11,554,298.

(60) Provisional application No. 62/900,378, filed on Sep. 13, 2019.

(51) Int. Cl.
*A63B 53/04* (2015.01)

(52) U.S. Cl.
CPC ..... *A63B 53/0445* (2020.08); *A63B 53/0408* (2020.08); *A63B 53/0466* (2013.01)

(58) Field of Classification Search
CPC ..... A63B 53/0445; A63B 53/0408; A63B 53/0466; A63B 53/04; A63B 53/047
See application file for complete search history.

(56) References Cited

U.S. PATENT DOCUMENTS

| | | | |
|---|---|---|---|
| 5,547,188 | A | 8/1996 | Dumontier et al. |
| 6,776,726 | B2 | 8/2004 | Sano |
| 7,297,072 | B2 | 11/2007 | Meyer et al. |
| 7,520,045 | B2 | 4/2009 | Lo |
| 7,549,934 | B2 | 6/2009 | Rice |
| 7,553,242 | B2 | 6/2009 | Meyer et al. |
| 7,704,162 | B2 | 4/2010 | Rice et al. |
| 7,850,541 | B2 | 12/2010 | Meyer et al. |
| 7,850,544 | B2 | 12/2010 | Meyer et al. |
| 7,946,931 | B2 | 5/2011 | Oyama |
| 8,038,544 | B2 | 10/2011 | Meyer et al. |
| 8,277,334 | B2 | 10/2012 | Meyer et al. |
| 8,439,769 | B2 | 5/2013 | Rice et al. |
| 8,894,507 | B2 | 11/2014 | Boyd et al. |
| 9,433,835 | B2 | 9/2016 | Sugimae et al. |
| 9,526,956 | B2 | 12/2016 | Murphy et al. |
| 9,533,202 | B2 | 1/2017 | Blevins et al. |
| 9,700,766 | B2 | 7/2017 | Sugimae et al. |
| 10,518,151 | B2 | 12/2019 | Blevins et al. |
| 2002/0028715 | A1 | 3/2002 | Galloway et al. |

(Continued)

FOREIGN PATENT DOCUMENTS

| | | |
|---|---|---|
| CN | 104096344 | 12/2016 |
| JP | 2002360749 | 12/2002 |

(Continued)

*Primary Examiner* — Michael D Dennis

(57) ABSTRACT

A golf club head having localized heat treatment is described herein. Other embodiments are disclosed.

20 Claims, 11 Drawing Sheets

(56) References Cited

U.S. PATENT DOCUMENTS

| | | | | |
|---|---|---|---|---|
| 2003/0008726 | A1* | 1/2003 | Sano | A63B 53/04 473/345 |
| 2004/0176182 | A1 | 9/2004 | Krumme et al. | |
| 2005/0009629 | A1 | 1/2005 | Chao et al. | |
| 2006/0154745 | A1* | 7/2006 | Johnson | A63B 60/00 473/345 |
| 2006/0293118 | A1 | 12/2006 | Meyer et al. | |
| 2007/0173346 | A1 | 7/2007 | Chiang et al. | |
| 2008/0102984 | A1 | 5/2008 | Chiang | |
| 2010/0317460 | A1 | 12/2010 | Hirano | |
| 2011/0045922 | A1* | 2/2011 | Hackel | A63B 60/00 473/345 |
| 2014/0274464 | A1 | 9/2014 | Schweigert et al. | |
| 2015/0148147 | A1 | 5/2015 | Boyd et al. | |
| 2016/0067560 | A1 | 3/2016 | Golden et al. | |
| 2016/0067561 | A1 | 3/2016 | Golden et al. | |
| 2017/0319916 | A1 | 11/2017 | Knuth et al. | |
| 2018/0154226 | A1 | 6/2018 | Milleman et al. | |
| 2018/0209010 | A1 | 7/2018 | Simone et al. | |
| 2018/0318666 | A1 | 11/2018 | Morales et al. | |
| 2019/0143182 | A1 | 5/2019 | Knuth et al. | |
| 2019/0201754 | A1 | 7/2019 | Hoffman et al. | |

FOREIGN PATENT DOCUMENTS

| | | |
|---|---|---|
| JP | 2008188366 | 8/2008 |
| TW | 200819171 | 5/2008 |
| WO | 201352343 | 4/2013 |
| WO | 2018204932 | 11/2018 |

* cited by examiner

GOLF CLUB HEADS HAVING A LOCALIZED HEAT AFFECTED ZONE

RELATED APPLICATION DATA

This is a continuation of U.S. Nonprovisional patent application Ser. No. 17/020,651, filed Sep. 14, 2020. This further claims the benefit of U.S. Provisional Patent Application No. 62/900,378, filed on Sep. 13, 2019, the contents of all of which are entirely incorporated herein by reference.

FIELD OF INVENTION

The present disclosure relates generally to golf clubs. In particular, the present disclosure relates to golf club heads having one or more localized heat affected zones (HAZ).

BACKGROUND

Characteristic Time (CT) is a measurement of the amount of time, in microseconds, that a golf ball is in contact with the faceplate during impact. Characteristic time requirements are one of the many rules that the United States Golf Association (USGA) and the Royal and Ancient Golf Club of St. Andrews (R&A) impose on golf equipment manufactures to determine club head conformance. Oftentimes, the characteristic time properties of golf club heads are not uniform and substantially varies across the faceplate. This variation can cause inconsistencies in club head performance, and more particularly produce different ball speeds depending on where the ball impact occurs on the faceplate. These minor variations in ball impact locations across the faceplate can lead to notable variations in produced ball speed and ball travel distance thereby making the game unpredictable to the golfer.

Variations in the characteristic time properties of the golf club head can be caused by faceplates with an asymmetrical perimeter geometry and/or variable faceplate features (i.e. thickness, material, texture, face-to-body transition, etc.). Reducing the thickness of materials used to form a golf club head, and more particularly a faceplate can be beneficial for many reasons. Among those reasons, a thinner faceplate can reduce weight, increase flexibility, and reduce the amount of materials used. A weight reduction in one area of the golf club head can allow for that weight to be redistributed (as desired) to increase clubhead performance.

Redistributing weight from the faceplate can lead to an increase in flexibility and an increase in energy transfer to the golf ball. This increase in flexibility (resulting from a thin faceplate) can lead to a more variable CT across the faceplate. There is a need in the art for a repeatable, efficient, and affordable manufacturing method that allows the CT to be locally altered to reduce CT variation across the faceplate.

Figure 1:
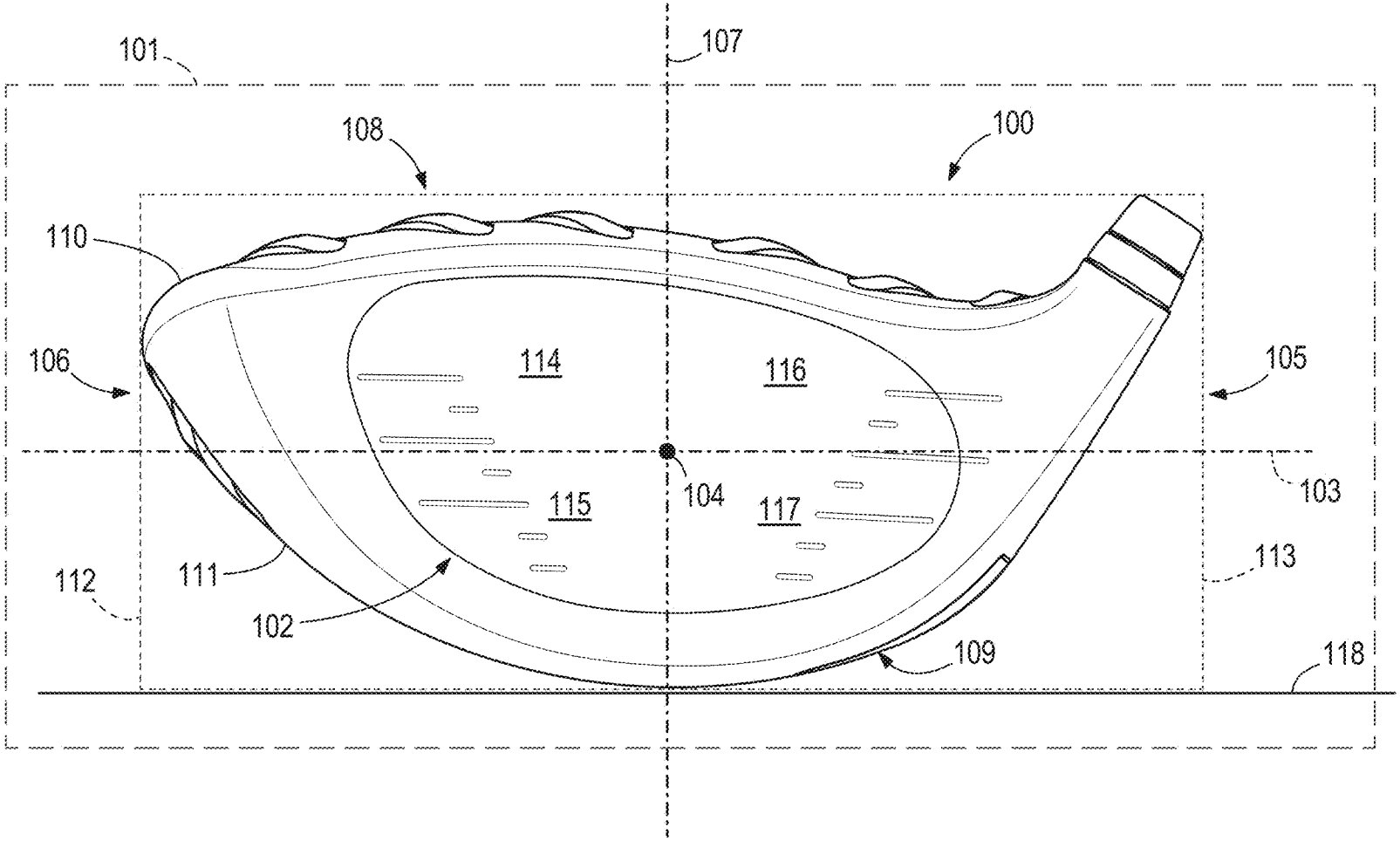
FIG. 1 illustrates a front view of a golf club head in an address position.

Other aspects of the disclosure will become apparent by consideration of the detailed description and accompanying drawings.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures are not necessarily drawn to scale. For example, the dimensions of some of the elements in the figures may be exaggerated relative to other elements to help improve understanding of embodiments of the present disclosure. The same reference numerals in different figures denotes the same elements.

DETAILED DESCRIPTION

Presented herein are golf club heads, and in particular, wood-type golf club heads comprising a faceplate having one or more heat affected zone(s) (HAZ) to enable a consistent or reasonable tolerance variation in CT over the entire faceplate. Heat affected zone(s) can be formed via weld beads that locally alters a certain zone, portion, or region of the faceplate without globally altering the characteristics and properties of the faceplate in its entirety. Locally altering a certain zone or region of the faceplate via weld bead(s) (or spot welds) to form a heat affected zone can alter the microstructure of that region or zone. Altering the microstructure, at targeted regions or zones can alter that the characteristic time properties of that region or zone when impacted by a golf ball.

As the characteristic time properties varies across the faceplate in both a heel-to-toe direction and in a crown-to-sole direction, the region(s) of the faceplate targeted by the heat treatment and/or HAZ can be those approaching a characteristic time threshold to avoid the golf club head having hot spots (i.e. portions of the faceplate at, approaching, or near the USGA and R&A CT limits), regions of the club head potentially having a non-compliant CT due to manufacturing variability; and/or a particular region of the faceplate falling out of compliance due to repeated clubhead use and wear. Following a faceplate having a localized heat affected zone treatment (via a weld bead or spot weld), the treated zone can have a different material characteristic than non-heat-affected zones of the same material (i.e. a different microstructure to modify CT). These zones, regions, or portions targeted for adjustment can generally be defined by a reference shape. Further, a method of manufacturing the golf club heads described herein is outlined below.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

The term "driver-type golf club head" described herein can be defined by one or more of a loft angle, a club head volume, a club head weight, or a club head material.

1. Loft Angle

In many embodiments, the loft angle of the driver-type club head can be less than approximately 16 degrees, less than approximately 15 degrees, less than approximately 14 degrees, less than approximately 13 degrees, less than approximately 12 degrees, less than approximately 11 degrees, less than approximately 10 degrees, less than approximately 9 degrees, less than approximately 8 degrees, or less than approximately 7 degrees.

2. Volume

Further, in many embodiments, the volume of the driver-type club head can be greater than approximately 400 cc, greater than approximately 425 cc, greater than approximately 450 cc, greater than approximately 475 cc, greater than approximately 500 cc, greater than approximately 525 cc, greater than approximately 550 cc, greater than approximately 575 cc, greater than approximately 600 cc, greater than approximately 625 cc, greater than approximately 650 cc, greater than approximately 675 cc, or greater than approximately 700 cc. In some embodiments, the volume of the driver-type club head can be approximately 400 cc-600 cc, 425 cc-500 cc, approximately 500 cc-600 cc, approximately 500 cc-650 cc, approximately 550 cc-700 cc, approximately 600 cc-650 cc, approximately 600 cc-700 cc, or approximately 600 cc-800 cc.

3. Weight

In many embodiments, the driver-type golf club head can have a weight (or mass) that ranges between 170 grams and 250 grams. In other embodiments, the driver-type golf club head can range between 170 grams-175 grams, 175 grams-180 grams, 180 grams-185 grams, 185 grams-190 grams, 190 grams-195 grams, 195 grams-200 grams, 200 grams-205 grams, 205 grams-210 grams, 210 grams-215 grams, 215 grams-220 grams, 220 grams-225 grams, 225 grams-230 grams, 230 grams-235 grams, 235 grams-240 grams, 240 grams-245 grams, or 245 grams-250 grams. In some embodiments, the weight of the driver-type golf club head can be 170 grams, 171 grams, 172 grams, 173 grams, 174 grams, 175 grams, 176 grams, 177 grams, 178 grams, 179 grams, 180 grams, 181 grams, 182 grams, 183 grams, 184 grams, 185 grams, 186 grams, 187 grams, 188 grams, 189 grams, 190 grams, 191 grams, 192 grams, 193 grams, 194 grams, 195 grams, 196 grams, 197 grams, 198 grams, 199 grams, 200 grams, 201 grams, 202 grams, 203 grams, 204 grams, 205 grams, 206 grams, 207 grams, 208 grams, 209 grams, 210 grams, 211 grams, 212 grams, 213 grams, 214 grams, 215 grams, 216 grams, 217 grams, 218 grams, 219 grams, 220 grams, 221 grams, 222 grams, 223 grams, 224 grams, 225 grams, 226 grams, 227 grams, 228 grams, 229 grams, 230 grams, 231 grams, 232 grams, 233 grams, 234 grams, 235 grams, 236 grams, 237 grams, 238 grams, 239 grams, 240 grams, 241 grams, 242 grams, 243 grams, 244 grams, 245 grams, 246 grams, 247 grams, 248 grams, 249 grams, or 250 grams.

4. Material

The material of the driver-type golf club head can be constructed from any material used to construct a conventional golf club head. For example, the material of the driver-type golf club head can be constructed from any one or combination of the following: 8620 alloy steel, S25C steel, carbon steel, maraging steel, 17-4 stainless steel, 1380 stainless steel, 303 stainless steel, stainless steel alloys, steel alloys, tungsten, aluminum, aluminum alloys, ADC-12, titanium, titanium alloys, or any other known metal or composite materials for creating a driver-type golf club head. In many embodiments, the driver-type golf club head can be constructed from a titanium and/or composite material.

The term "fairway wood-type golf club head" described herein can be defined by one or more of a loft angle, a club head volume, a club head weight, or a club head material.

1. Loft Angle

In many embodiments, the loft angle of the fairway wood-type club head can be less than approximately 35 degrees, less than approximately 34 degrees, less than approximately 33 degrees, less than approximately 32 degrees, less than approximately 31 degrees, or less than approximately 30 degrees. Further, in many embodiments, the loft angle of the club head is greater than approximately 12 degrees, greater than approximately 13 degrees, greater than approximately 14 degrees, greater than approximately 15 degrees, greater than approximately 16 degrees, greater than approximately 17 degrees, greater than approximately 18 degrees, greater than approximately 19 degrees, or greater than approximately 20 degrees. For example, in some embodiments, the loft angle of the fairway wood-type club head can be between 12 degrees and 35 degrees, between 15 degrees and 35 degrees, between 20 degrees and 35 degrees, or between 12 degrees and 30 degrees.

2. Volume

In many embodiments, the volume of the fairway wood-type club head is less than approximately 400 cc, less than approximately 375 cc, less than approximately 350 cc, less than approximately 325 cc, less than approximately 300 cc, less than approximately 275 cc, less than approximately 250 cc, less than approximately 225 cc, or less than approximately 200 cc. In some embodiments, the volume of the club head can be approximately 150 cc-200 cc, approximately 150 cc-250 cc, approximately 150 cc-300 cc, approximately 150 cc-350 cc, approximately 150 cc-400 cc, approximately 300 cc-400 cc, approximately 325 cc-400 cc, approximately 350 cc-400 cc, approximately 250 cc-400 cc, approximately 250-350 cc, or approximately 275-375 cc.

3. Weight

In many embodiments, the fairway wood-type golf club head can have a weight that ranges between 170 grams and 215 grams. In other embodiments, the fairway wood-type golf club head can range between 170 grams-175 grams, 175 grams-180 grams, 180 grams-185 grams, 185 grams-190 grams, 190 grams-195 grams, 195 grams-200 grams, 200 grams-205 grams, 205 grams-210 grams, or 210 grams-215 grams. In some embodiments, the weight of the fairway wood-type golf club head can be 170 grams, 171 grams, 172 grams, 173 grams, 174 grams, 175 grams, 176 grams, 177 grams, 178 grams, 179 grams, 180 grams, 181 grams, 182 grams, 183 grams, 184 grams, 185 grams, 186 grams, 187 grams, 188 grams, 189 grams, 190 grams, 191 grams, 192 grams, 193 grams, 194 grams, 195 grams, 196 grams, 197 grams, 198 grams, 199 grams, 200 grams, 201 grams, 202 grams, 203 grams, 204 grams, 205 grams, 206 grams, 207 grams, 208 grams, 209 grams, 210 grams, 211 grams, 212 grams, 213 grams, 214 grams, or 215 grams.

4. Material

The material of the fairway wood-type golf club head can be constructed from any material used to construct a conventional golf club head. For example, the material of the fairway wood-type golf club head can be constructed from any one or combination of the following: 8620 alloy steel, S25C steel, carbon steel, maraging steel, 17-4 stainless steel, 1380 stainless steel, 303 stainless steel, stainless steel alloys, steel alloys, tungsten, aluminum, aluminum alloys, ADC-12, titanium, titanium alloys, steel alloys or any other known metal or composite material for creating a fairway wood-type golf club head. In many embodiments, the fairway wood-type golf club head is constructed from a titanium alloy and/or composite material.

The term "hybrid-type golf club head" described herein can be defined by one or more of a loft angle, a club head volume, a club head weight, or a club head material.

5. Loft Angle

In many embodiments, the loft angle of the hybrid-type club head can be less than approximately 40 degrees, less than approximately 39 degrees, less than approximately 38 degrees, less than approximately 37 degrees, less than approximately 36 degrees, less than approximately 35 degrees, less than approximately 34 degrees, less than approximately 33 degrees, less than approximately 32 degrees, less than approximately 31 degrees, or less than approximately 30 degrees. Further, in many embodiments, the loft angle of the hybrid-type club head is greater than approximately 16 degrees, greater than approximately 17 degrees, greater than approximately 18 degrees, greater than approximately 19 degrees, greater than approximately 20 degrees, greater than approximately 21 degrees, greater than approximately 22 degrees, greater than approximately 23 degrees, greater than approximately 24 degrees, or greater than approximately 25 degrees.

6. Volume

In many embodiments, the volume of the hybrid-type club head is less than approximately 200 cc, less than approximately 175 cc, less than approximately 150 cc, less than approximately 125 cc, less than approximately 100 cc, or less than approximately 75 cc. In some embodiments, the volume of the club head can be approximately 100 cc-150 cc, approximately 75 cc-150 cc, approximately 100 cc-125 cc, or approximately 75 cc-125 cc.

7. Weight

In many embodiments, the hybrid-type golf club head can have a weight that ranges between 190 grams and 240 grams. In other embodiments, the fairway wood-type golf club head can range between 190 grams-195 grams, 195 grams-200 grams, 200 grams-205 grams, 205 grams-210 grams, 210 grams-215 grams, 215 grams-220 grams, 220 grams-225 grams, 225 grams-230 grams, 230 grams-235 grams, or 235 grams-240 grams. In some embodiments, the weight of the hybrid-type golf club head can be 190 grams, 191 grams, 192 grams, 193 grams, 194 grams, 195 grams, 196 grams, 197 grams, 198 grams, 199 grams, 200 grams, 201 grams, 202 grams, 203 grams, 204 grams, 205 grams, 206 grams, 207 grams, 208 grams, 209 grams, 210 grams, 211 grams, 212 grams, 213 grams, 214 grams, 215 grams, 216 grams, 217 grams, 218 grams, 219 grams, 220 grams, 221 grams, 222 grams, 223 grams, 224 grams, 225 grams, 226 grams, 227 grams, 228 grams, 229 grams, 230 grams, 231 grams, 232 grams, 233 grams, 234 grams, 235 grams, 236 grams, 237 grams, 238 grams, 239 grams or 240 grams.

8. Material

The material of the hybrid-type golf club head can be constructed from any material used to construct a conventional golf club head. For example, the material of the hybrid-type golf club head can be constructed from any one or combination of the following: 8620 alloy steel, S25C steel, carbon steel, maraging steel, 17-4 stainless steel, 1380 stainless steel, 303 stainless steel, stainless steel alloys, steel alloys, tungsten, aluminum, aluminum alloys, ADC-12, titanium, titanium alloys, steel alloys or any other known metal or composite for creating a hybrid-type golf club head. In many embodiments, the hybrid-type golf club head can be constructed from a titanium alloy and/or composite material.

The term "spot weld" described herein can be defined as applying a weld bead, at a specified location, to a material, to create a heat affected zone that changes the physical grain structure from an equiaxed, circular microstructure to a dendrite microstructure, and wherein the material microstructure transforms back to the equiaxed, circular microstructure away from the spot weld.

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways.

Described below are golf club heads comprising reference shapes to help provide consistent CT across the faceplate. The reference shape comprise heat affected zone(s) (HAZ) that provides the ability to reduce/limit certain regions CT characteristics thereby creating a CT that is within a predetermined tolerance across the face. More specifically described herein are golf club heads, and in particular, are golf club heads (drivers, fairway woods, or hybrids) comprising a faceplate having at least one heat affected zone (HAZ) to enable a consistent CT (or within a predetermined tolerance) over the entire faceplate of the golf club head. As discussed above, heat affected zone(s) can be formed via spot welds or weld beads that alters a certain zone, portion, or region of the face plate without globally altering the characteristics and properties of the faceplate in its entirety. Locally altering a certain zone or region of the face plate (via a spot weld or weld bead) to form a heat affected zone(s) can alter the microstructure (to a dendritic microstructure) of that region or zone, and thus, can alter the characteristic time properties of the treated location.

For example, and in general, portions of a golf club head having the greatest characteristic time measurements can typically be found (1) towards the geometric center of the faceplate, (2) offset from the geometric center of the faceplate towards the toe of the faceplate, (3) offset from the geometric center towards the top end of the faceplate, or combinations thereof. These areas can potentially have a characteristic time measurement that is at, near, or approaching a threshold CT value (i.e. a USGA and R&A CT limit).

To form a faceplate with a more uniform CT (i.e. devoid of "CT hotspots"), the region of target for a local heat affected zone can be characterized by a reference shape. Inside or on a perimeter of the reference shape, a localized heat affected zone can be formed via a spot weld or weld bead. The heat affected zone within the reference shape can have a different material characteristic (i.e. a different or (dendritic) microstructure) than non-heat-affected zones outside of the reference shape to locally modify CT.

Golf Club Head

The golf club head described herein can be a driver-type club head, a fairway wood-type golf club, or a hybrid-type club head as defined above. In many embodiments, the golf club head can be a wood-type golf club head (i.e. a driver-type golf club head, a fairway wood-type golf club head, or a hybrid-type golf club head). Driver-type golf club heads, fairway wood-type golf club heads, and hybrid-type golf club heads can be characterized by a loft angle, a head volume, and/or by a head weight as mentioned above.

In some embodiments, the golf club head can be formed from a stainless steel, titanium, aluminum, or steel alloy (e.g. 455 steel, 475 steel, 431 steel, 17-4 stainless steel, maraging steel), a titanium alloy (e.g. Ti 7-4, Ti 6-4, T-9S), an aluminum alloy, or a composite material. In some embodiments, the faceplate of the golf club head can be formed from a stainless steel, titanium, aluminum, or a steel alloy (e.g. 455 steel, 475 steel, 431 steel, 17-4 stainless steel, maraging steel), a titanium alloy (e.g. Ti 7-4, Ti 6-4, T-9S), an aluminum alloy, or a composite material.

Composition and Setup of Golf Club Head

In many embodiments, the golf club head 100 comprises a club head body 124 (may also be referred to as "body"). The club head body 124 forms a toe portion 106, a heel portion 105, a top portion 108, a sole portion 109, a rear portion 125 and a faceplate opening configured to receive a faceplate 102. The faceplate 102 can provide a surface adapted for impact with a golf ball. The rear portion 125 is rearwardly spaced from the faceplate 102. The sole portion 109 is defined as being between the faceplate 102 and the rear portion 125, and resting on a ground plane 118 (or playing surface) at an address position. The top portion 108 can be formed opposite the sole portion 109. The faceplate 102 is defined by the sole portion 109, the top portion 108, the heel portion 105, and the toe portion 106 which is opposite the heel portion 105.

As previously mentioned, the golf club head 100 can be configured to reside in the "address position". Unless otherwise described or stated, the golf club head 100 is in an address position for all reference measurements, ratios, and/or descriptive parameters. The address position can be referred to as being in a state where (1) the sole portion of the golf club head rests on the ground plane 118, which contacts and is parallel to a playing surface and (2) the striking surface can be substantially perpendicular to the ground plane.

The faceplate 102 of the clubhead 100 defines a geometric center 104. In some embodiments, the geometric center 104 can be located at the geometric centerpoint of a faceplate perimeter, and at a midpoint of face height. In the same or other examples, the geometric center also can be centered with respect to engineered impact zone, which can be defined by a region of grooves on the faceplate. As another approach, the geometric center of the faceplate 102 can be located in accordance with the definition of a golf governing body such as the United States Golf Association (USGA). For example, the geometric center of the faceplate 102 can be determined in accordance with Section 6.1 of the USGA's Procedure for Measuring the Flexibility of a Golf Clubhead (USGA-TPX3004, Rev. 1.0.0, May 1, 2008) (available at http://www.usga.org/equipment/testing/protocols/Procedure-For-Measuring-The-Flexibility-Of-A-Golf-Club-Head/) (the "Flexibility Procedure").

The club head 100 further defines a loft plane tangent to the geometric center 104 of the faceplate 102. The face height can be measured parallel to the loft plane between a top end of the faceplate perimeter near the crown portion 108 and a bottom end of the faceplate perimeter near the sole portion 109. In these embodiments, the perimeter of the faceplate 102 can be located along the outer edge of the faceplate where the curvature deviates from the bulge and/or roll of the faceplate 102.

The geometric center 104 of the faceplate 102 further defines a coordinate system having an origin located at the geometric center of the faceplate 102, the coordinate system having an X' axis 103, a Y' axis 107, and a Z' axis. The X' axis 103 extends through the geometric center 104 of the faceplate 102 in a direction from the heel 105 to the toe 106 of the club head 100. The Y' axis 107 extends through the geometric center 104 of the faceplate 102 in a direction from the crown 108 to the sole 109 of the club head 100 and perpendicular to the X' axis 103, and the Z' axis extends through the geometric center 104 of the faceplate 102 in a direction from the front end to the back end of the club head 100 and perpendicular to the X' axis 103 and the Y' axis 107.

The coordinate system defines an X'Y' plane 101 extending through the X' axis 103 and the Y' axis 107. The X'Y' plane 101 extends parallel to a hosel axis (not shown) and is positioned at an angle corresponding to the loft angle of the club head 100 from the loft plane. Further the X' axis 103 can be positioned at a 60 degree angle to the hosel axis when viewed from a direction perpendicular to the X'Y' plane. In these or other embodiments, the club head can be viewed from a front view (FIG. 1) when the faceplate 102 is viewed from a direction perpendicular to the X'Y' plane 101.

When the golf club head 100 is at an address position, the golf club head 100 can be divided into four quadrants (i.e. a first quadrant, a second quadrant, a third quadrant, and a fourth quadrant) bounded by the perimeter of the faceplate 102, the X' axis 103, and the Y' axis 107. Within one or more quadrants, a reference shape 126 can be projected onto the faceplate 102 and can harbor a HAZ zone to alter an area having a characteristic time value that is generally greater than a threshold or targeted characteristic time. In many embodiments, the reference shape 126 in its entirety can be bounded or located within the first quadrant, the second quadrant, the third quadrant, or the fourth quadrant. In alternative embodiments, the reference shape 126 can extend into one or more quadrants, two or more quadrants, or three or more quadrants. In other embodiments, the reference shape 126 can extend along a quadrant border (i.e. along the X' axis or Y' axis) and into one or more quadrants.

In most embodiments, one or more HAZ zone(s) can be located within a high toe quadrant. In some embodiments, one or more HAZ zone(s) can be located in both a low toe and high toe quadrant. In some embodiments, one or more HAZ zone(s) can be located in both a high toe and high heel quadrant. In a few embodiments, one or more HAZ zone(s) can be in a high toe and low heel quadrant. In alternatives embodiments, one or more HAZ zone(s) can be in all quadrants and/or clustered around the geometric center.

The reference shape 126 can take the form of any shape and preferably does not extend into a body portion of the club head 100 (i.e. only located on the faceplate 102). For example, in many embodiments, the reference shape 126 can be substantially triangular, square, rectangular, polygonal, semi-circular, curvilinear, or the like. The reference shape generally comprises of an area having a characteristic time value that is generally greater than a threshold or targeted characteristic time value.

The one or more characteristic time value(s) on a faceplate 102 that is greater than a threshold, designed, or targeted characteristic time measurement due to manufacturer variability can be detected or located via (1) the standard USGA test method for measuring characteristic time via a heat seeking process (which looks to identify the location and value of the greatest characteristic time value(s) of a club head by taking measurements at strategically chosen locations) or (2) by identifying a known area of concern through an aggregation of CT data. Upon detection or identification of a region, area, and/or location of the golf club head having a characteristic time value approaching a threshold CT value, the given region, area, and/or location of the golf club head can be imposed or configured to a localized weld bead (or spot weld) to create a heat affected zone (HAZ).

This creates a faceplate 102 having a non-uniform microstructure (see FIGS. 6-9). Imposing a localized weld bead or spot weld to create a heat affected zone to a given area of interest on the faceplate 102 can alter the CT properties of the treated zone. In other words, a faceplate region (or location) approaching or greater than a threshold CT value can be subjected to a weld bead or spot weld to create a heat affected zone that locally alters the microstructure (to locally create a higher strength and/or stiffened region) of the treated region to the point, in which the CT properties of that area decreases in accordance with a value at or below the targeted CT threshold. Therefore, instead of altering the profile of the club head to accommodate for a faceplate region having high CT region, (i.e. increasing the thickness of the face, modifying the variable face thickness profile of the faceplate, introducing club head reinforcing elements, etc.) the applied HAZ structure reduces the dependency on global (or large-scale) design modifications to the club head, and alternatively focuses on locally altering the microstructure (or small-scale) modifications to the faceplate 102.

I. EMBODIMENTS

In many of the golf club head 100 embodiments described below, a heat affected zone can be found in a certain area of the faceplate 102, and further the heat affected zone can border or be entirely located within a reference shape 126. As mentioned above, and discussed in detail below, depositing a weld bead or spot weld within a reference shape creates a HAZ region forming a dendritic microstructure (different from non-spot-welded areas). In area(s), where CT properties are at or above a threshold value, placing a spot weld at location(s) of concern, results in a CT reduction due to the dendritic microstructure properties. The reference shape can more easily assist an individual with identifying a location of CT correction, as it creates an outline around and/or over the area targeted for CT adjustment.

In many embodiments, the golf club head 100 can also be viewed in a perpendicular direction to an XY' plane 101 and faceplate 102 as shown by FIGS. 1-8. When viewing the golf club head in a generally perpendicular direction to the XY' plane 101 and the faceplate 102, the golf club head 100 can be defined by a coordinate system having an X' axis 103 that extends through the geometric center 104 of the faceplate 102 in a heel 105-to-toe 106 direction and a Y' axis 107 that extends through the geometric center 104 in a top-to-bottom (or crown 108-to-sole 109) direction.

The X' axis 103 horizontally divides the golf club head into an upper region 110 and a lower region 111. The upper region 110 of the golf club head is bounded by the X' axis 103, the crown 108, and the maximum heel-to-toe width of the club head. The lower region 111 of the golf club head is bounded by the X' axis 103, the sole 109, and the maximum heel to toe width of the golf club head. The Y' axis 107 vertically separates the club head into a left region 112 and a right region 113. The left region 112 can be bounded by the Y' axis and the toe end of the golf club head. The right region can be bounded by the Y' axis 107 and the heel 105 of the golf club head 100. Further, the X' axis 103 and the Y' axis 107 are perpendicular to each other and form four faceplate quadrant regions.

The four face plate quadrant regions can be defined as a center-to-high toe quadrant 114, center-to-low toe quadrant 115, a center-to-high heel quadrant 116, and a center-to-low heel quadrant 117 when the golf club head is resting on the ground plane 118 at an address position. The center-to-high toe quadrant 114 extends from the geometric center 104 and spans the upper, left face plate region. The center-to low toe quadrant 115 extends from the geometric center 104 and spans the lower, left face plate region. The center-to-high heel quadrant 116 extends from the geometric center 104 and spans the upper, right face plate region. The center-to-low heel quadrant 117 extends from the geometric center 104 and spans the lower, right faceplate region.

The one or more faceplate quadrant regions 114, 115, 116, 117 can comprise of a characteristic time value that is either at, exceeding, or approaching a targeted characteristic time value. In many embodiments, the quadrant of focus can be the center-to-high toe quadrant 114, as this region can be identified as the critical region that comprises one or more locations approaching a critical CT threshold value due to manufacturing tolerances and/or variability.

Figure 2:
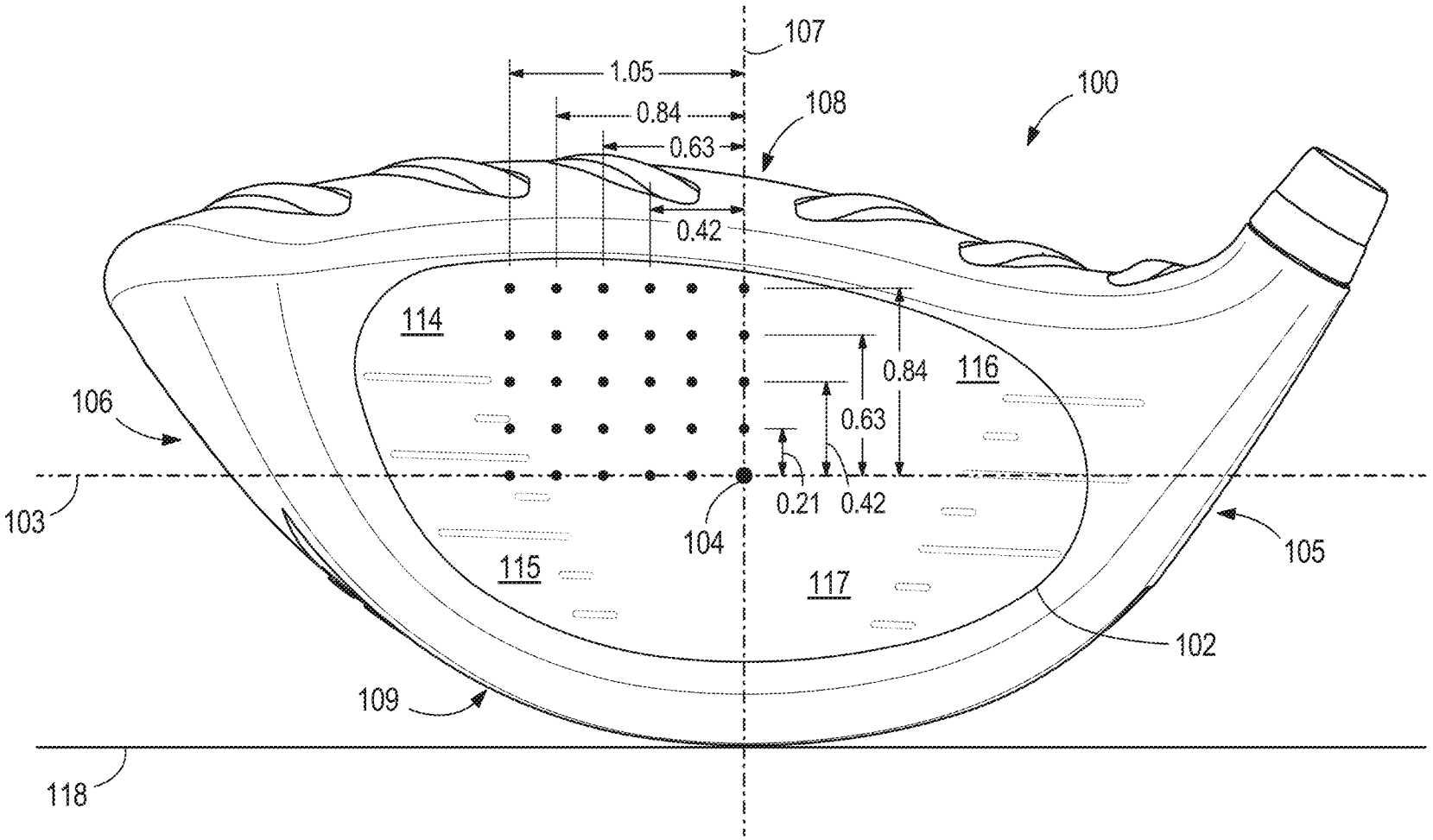
FIG. 2 illustrates a front view of a golf club head in an address position with CT reference measurement locations.

As shown by FIG. 2, the setup (or address) position of FIGS. 1 and 2 are similar. FIG. 2 further maps a plurality of potential location points within the center-to-high toe quadrant 114 to identify whether the faceplate characteristic time values are either at, approaching, or exceeding a targeted characteristic time limit. In general, typically, CT readings are emphasized in the center-to-high toe as this is a known quadrant for concern. Further provided in the example section, Table 1 provides an average of approximate CT readings (in microseconds) at corresponding mapped location points on the club head within the center-toe high toe quadrant 114 for respective faceplates devoid of a HAZ. In other words, the faceplate 102 of FIG. 2 and Table 1 have a uniform microstructure.

Figure 6:
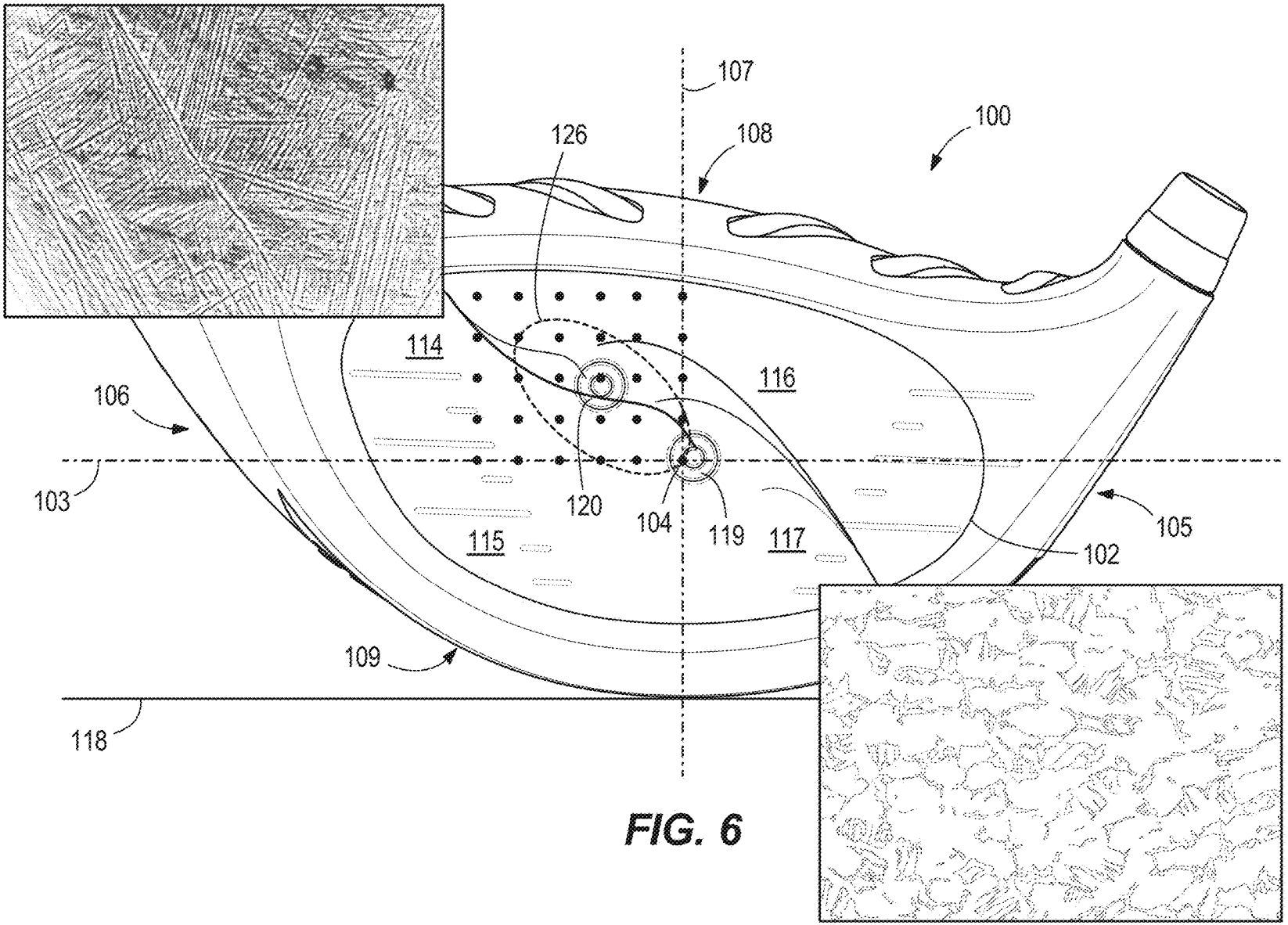
FIG. 6 illustrates a front view of a golf club head in an address position with a ellipsoidal reference shape and one or more HAZ zones.

As further illustrated by FIG. 6, the first spot weld 119 and the second spot weld 120 formed on the faceplate 102 locally changes the microstructure of the faceplate 102 within the heat effected zone mentioned above. The microstructure of the heat effected zone caused by the spot weld forms a dendrite structure that are needle-like or finger-like structures that produce smaller grain boundaries to stiffen or increase the faceplate strength in the welded (or HAZ) region. This localized stiffening directly correlates to a decrease in characteristic time of that region as faceplate flexibility is limited. The locations outside of the weld pool and heat effected zones (i.e. locations unaffected by the spot weld) have a homogenous microstructure with larger grain boundaries relative to the grain boundaries of the heat affected zone(s). In many embodiments, the HAZ structure defined by the spot weld creates a faceplate having a 2% to 6% increase in dendrite microstructures compared to non-spot-welded faceplates.

As can be seen, by the below example, golf club heads having a faceplate with a uniform microstructure or a non-HAZ structure within the center-to-high toe quadrant can have characteristic time values that vary by as much as 20 μs in the crown-to-sole direction and the heel-to-toe direction. Furthermore, a point measured immediately adjacent another point can vary by as much as 16 μs. Depending upon the location of golf ball impact, having a golf club head with a faceplate 102 having a widespan of characteristic time properties can negatively affect produced ball speeds. In many golf clubs head embodiments, it is desired to have characteristic time properties with a given quadrant to be more uniform (i.e. less variation in a heel-to-toe and crown-to-sole direction).

Upon identification of a quadrant having a high degree of variation and/or that meets or exceeds a designed CT parameter, a reference shape can be projected onto the quadrant, and more particularly, the location of focus, and thereby the HAZ zone. The reference shape can either surround or partially encompass the location of focus. As will be described below, in many embodiments, the reference shape can encompass a large area of focus or a small area of focus depending upon the faceplate 102 CT properties.

Rectangular Reference Shape

In many embodiments, a heat affected zone can be found in a certain area of the faceplate, and further the heat affected zone can border or be entirely located within a reference shape. Depositing a weld bead or spot weld within the reference shape creates a HAZ region forming a dendritic microstructure (different from non-spot-welded areas). In areas, where CT properties are at or above a threshold value, placing a spot weld at location(s) of concern, results in a CT reduction due to the dendritic microstructure properties. The reference shape can more easily assist an individual with identifying a location of CT correction, as it creates an outline around and/or over the area targeted for CT adjustment.

Figure 3:
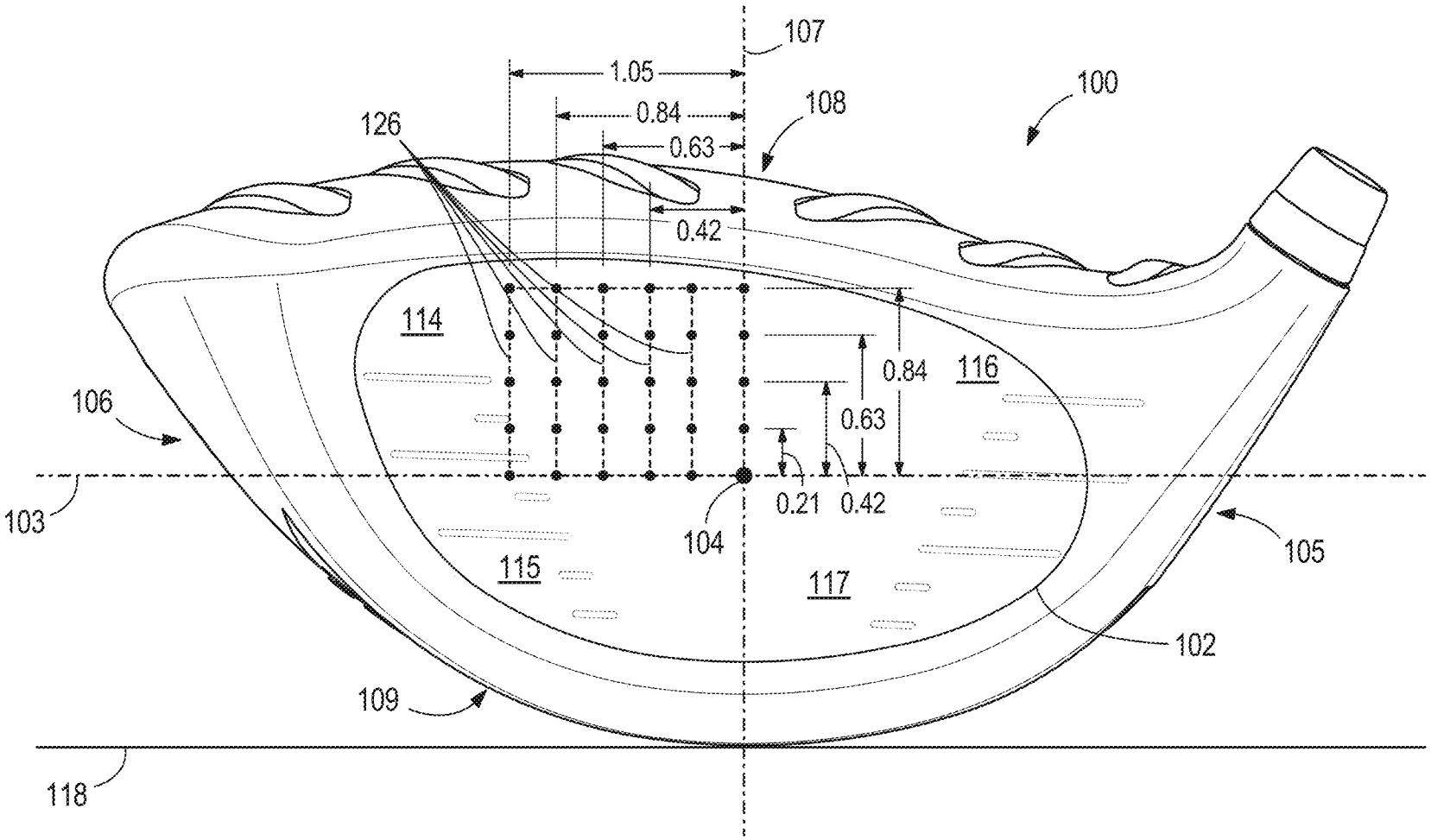
FIG. 3 illustrates a front view of a golf club head in an address position with a rectangular reference shape.

As illustrated by FIG. 3, in many embodiments, the reference shape 126 that encompasses an area of focus (i.e. one or more faceplate CT measurements that meets or exceeds a designed CT parameter) can be substantially rectangular. Alternatively, the reference shape 126, can be in the form of a square that can extend from the geometric center 104 of the faceplate 102 to a point within the center-to-high toe quadrant 114.

The rectangular (or square) reference shape 126 can have a height measured within the loft plane, in a crown to sole direction that extends between approximately 5% and approximately 50% of a total height of the faceplate 102. In many embodiments, the height of the rectangular reference shape 126 can be between approximately 5%-approximately 10%, approximately 10%-approximately 15%, approximately 15%-approximately 20%, approximately 20%-approximately 25%, approximately 25%-approximately 30%, approximately 30%-approximately 35%, approximately 35%-approximately 40%, approximately 40%-approximately 45%, or approximately 45% to approximately 50% of the total height of the faceplate 102.

In alternative embodiments, the rectangular reference shape 126 can have a maximum height measured within the loft plane, in a crown-to-sole direction between approximately 0 inch and 1.05 inches. In many embodiments, the maximum height of the rectangular reference shape 126 can be between approximately 0 inch-approximately 0.25 inches, approximately 0.25 inches-approximately 0.5 inches, approximately 0.5 inches-approximately 0.75 inches, approximately 0.75 inches-1.00 inches, or approximately 1.00 inches to approximately 1.05 inches. In other embodiments, the maximum height of the rectangular reference shape can be greater than approximately 0 inches, greater than approximately 0.25 inches, greater than approximately 0.5 inches, greater than approximately 0.75 inches, or greater than approximately 1 inch. In alternative embodiments, the maximum height of the rectangular reference shape can be less than approximately 1.05 inches, less than approximately 1.0 inch, less than approximately 0.75 inches, less than approximately 0.5 inches, or less than approximately 0.25 inches.

The rectangular (or square) reference shape 126 can have a width measured within the loft plane, in a heel to toe direction between approximately 5% and approximately 25% of a total width of the faceplate 102. In many embodiments, the width of the rectangular reference shape 126 can be between approximately 5%-approximately 10%, approximately 10%-approximately 15%, approximately 15%-approximately 20%, or approximately 20%-approximately 25% of the total width of the faceplate 102.

In alternative embodiments, the rectangular reference shape can have a maximum width measured within the loft plane, in a heel-to-toe direction between approximately 0 inch and 1.05 inches. In many embodiments, the maximum width of the rectangular reference shape 126 can be between approximately 0 inch-approximately 0.25 inches, approximately 0.25 inches-approximately 0.5 inches, approximately 0.5 inches-approximately 0.75 inches, approximately 0.75 inches-1.00 inches, or approximately 1.00 inches to approximately 1.05 inches. In other embodiments, the maximum width of the rectangular reference shape 126 can be greater than approximately 0 inches, greater than approximately 0.25 inches, greater than approximately 0.5 inches, greater than approximately 0.75 inches, or greater than approximately 1 inch. In alternative embodiments, the maximum width of the rectangular reference shape 126 can be less than approximately 1.05 inches, less than approximately 1.0 inch, less than approximately 0.75 inches, less than approximately 0.5 inches, or less than approximately 0.25 inches.

Ellipsoidal Reference Shape

As discussed above, a heat affected zone can be found in a certain area of the faceplate 102, and further the heat affected zone can either border or be entirely located within a reference shape 126. Depositing a weld bead or spot weld within the reference shape creates a HAZ region forming a dendritic microstructure (different from non-spot-welded areas). In areas, where CT properties are at or above a threshold value, placing a spot weld at location(s) of concern, results in a CT reduction due to the dendritic microstructure properties. The reference shape 126 can more easily assist an individual with identifying a location of CT correction, as it creates an outline around and/or over the area targeted for CT adjustment.

Figure 4:
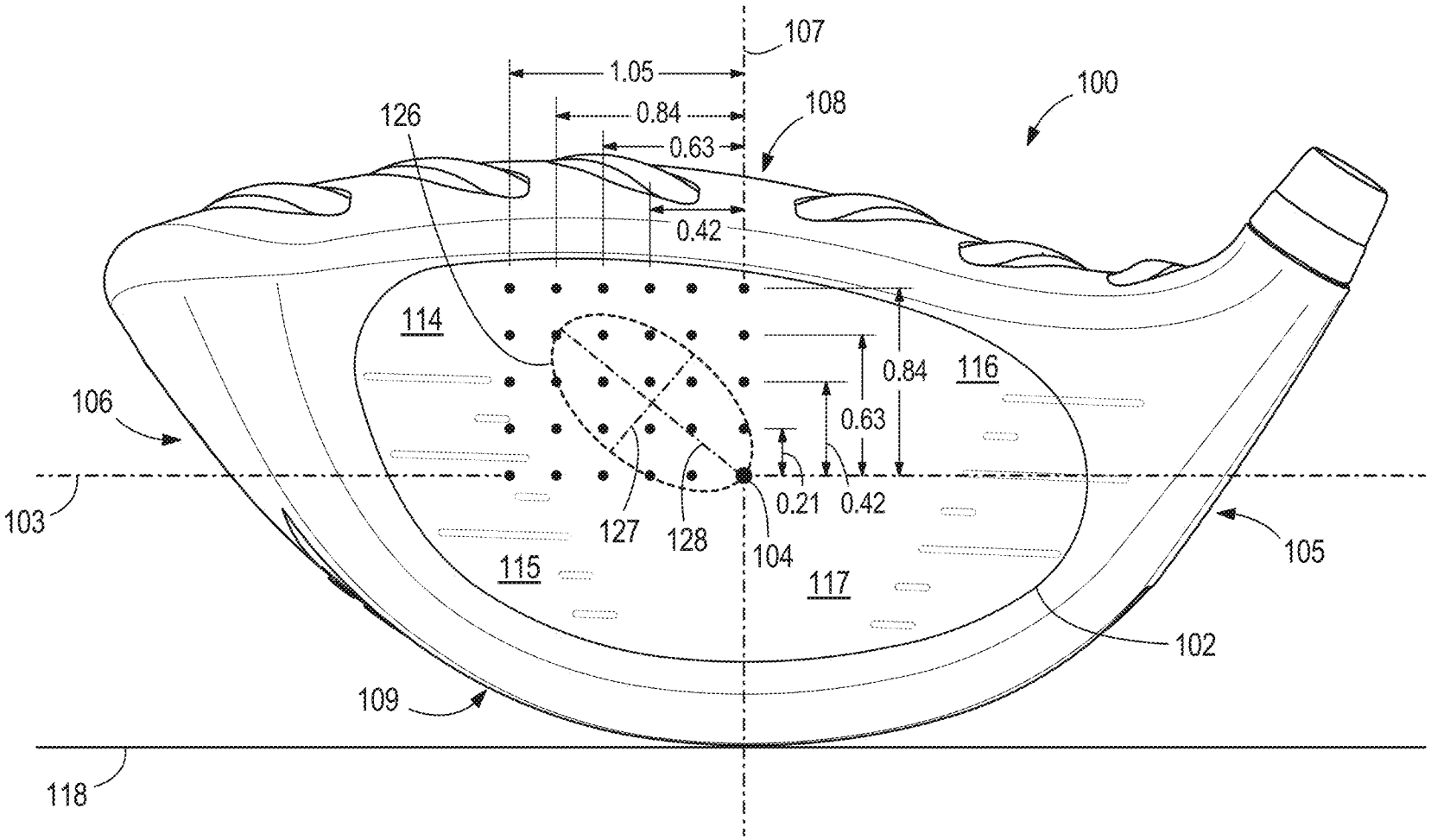
FIG. 4 illustrates a front view of a golf club head in an address position with a ellipsoidal reference shape.

As illustrated by FIG. 4, in many embodiments, the reference shape 126 that encompasses an area of focus (i.e. one or more faceplate CT measurements that meets or exceeds a designed CT parameter) for applying a HAZ region can be substantially ellipsoidal. The reference shape 126, and more particularly, the ellipsoidal reference shape 126 can extend from the geometric center 104 of the faceplate 102 to a point within the center-to-high toe quadrant 114.

An exemplary ellipsoidal reference shape can have a minor axis 127 measured within the loft plane and through the center of the ellipse, that can be between approximately 5% and approximately 50% of a total height of the faceplate 102. In many embodiments, the minor axis of the ellipsoidal reference shape 126 can be between approximately 5%-approximately 10%, approximately 10%-approximately 15%, approximately 15%-approximately 20%, approximately 20%-approximately 25%, approximately 25%-approximately 30%, approximately 30%-approximately 35%, approximately 35%-approximately 40%, approximately 40%-approximately 45%, or approximately 45% to approximately 50% of the total height of the faceplate 102.

In alternative embodiments, the ellipsoidal reference shape 126 can have a minor axis 127 measured within the loft plane, between approximately 0 inch and 1.05 inches. In many embodiments, the minor axis 127 measurement dimension of the ellipsoidal reference shape 126 can be between approximately 0 inch-approximately 0.25 inches, approximately 0.25 inches-approximately 0.5 inches, approximately 0.5 inches-approximately 0.75 inches, approximately 0.75 inches-1.00 inches, or approximately 1.00 inches to approximately 1.05 inches. In other embodiments, the minor axis 127 of the ellipsoidal reference shape can be greater than approximately 0 inches, greater than approximately 0.25 inches, greater than approximately 0.5 inches, greater than approximately 0.75 inches, or greater than approximately 1 inch. In alternative embodiments, the minor axis 127 of the ellipsoidal reference shape can be less than approximately 1.05 inches, less than approximately 1.0 inch, less than approximately 0.75 inches, less than approximately 0.5 inches, or less than approximately 0.25 inches.

The ellipsoidal reference shape 126 can have a major axis 128 measured within the loft plane, that can be between approximately 5% and approximately 25% of a total height of the faceplate 102. In many embodiments, the major axis 128 of the ellipsoidal reference shape 126 can be between approximately 5%-approximately 10%, approximately 10%-approximately 15%, approximately 15%-approximately 20%, or approximately 20%-approximately 25% of the total height of the faceplate 102.

In alternative embodiments, the ellipsoidal reference shape 126 can have a major axis 128 measured within the loft plane, between approximately 0 inch and 1.05 inches. In many embodiments, the major axis 128 of the ellipsoidal reference shape 126 can be between approximately 0 inch-approximately 0.25 inches, approximately 0.25 inches-approximately 0.5 inches, approximately 0.5 inches-approximately 0.75 inches, approximately 0.75 inches-1.00 inches, or approximately 1.00 inches to approximately 1.05 inches. In other embodiments, the major axis 128 of the ellipsoidal reference shape 126 can be greater than approximately 0 inches, greater than approximately 0.25 inches, greater than approximately 0.5 inches, greater than approximately 0.75 inches, or greater than approximately 1 inch. In alternative embodiments, the major axis 128 of the ellipsoidal reference shape 126 can be less than approximately 1.05 inches, less than approximately 1.0 inch, less than approximately 0.75 inches, less than approximately 0.5 inches, or less than approximately 0.25 inches.

In many embodiments, the major axis 128 of the ellipsoidal reference shape 126 can be at an angle relative to the x-axis 103. The angle between the major axis 128 of the ellipsoidal reference shape and the x-axis 103 can be between 20 degrees and 80 degrees. In many embodiments, the angle formed between the ellipsoidal reference shape 126 and the x-axis 103 can vary based upon the location of focus. In some embodiments, the angle of the major axis and the x-axis can be between approximately 20 degrees-approximately 25 degrees, approximately 30 degrees-approximately 35 degrees, approximately 35 degrees-approximately 40 degrees, approximately 40 degrees to approximately 45 degrees, approximately 45 degrees-approximately 50 degrees, approximately 50 degrees to approximately 55 degrees, approximately 55 degrees to approximately 60 degrees, approximately 60 degrees to approximately 65 degrees, approximately 65 degrees to approximately 70 degrees, approximately 70 degrees to approximately 75 degrees, or approximately 75 degrees to approximately 80 degrees. In many embodiments, the formed angle can be approximately 45 degrees.

Linear Reference Shape

As discussed above, a heat affected zone can be found in a certain area of the faceplate, and further the heat affected zone can either border or be entirely located within a reference shape 126. Depositing a weld bead or spot weld within the reference shape 126 creates a HAZ region forming a dendritic microstructure (different from non-spot-welded areas). In areas, where CT properties are at or above a threshold value, placing a spot weld at location(s) of concern, results in a CT reduction due to the dendritic microstructure properties. The reference shape can more easily assist an individual with identifying a location of CT correction, as it creates an outline around and/or over the area targeted for CT adjustment.

Figure 5:
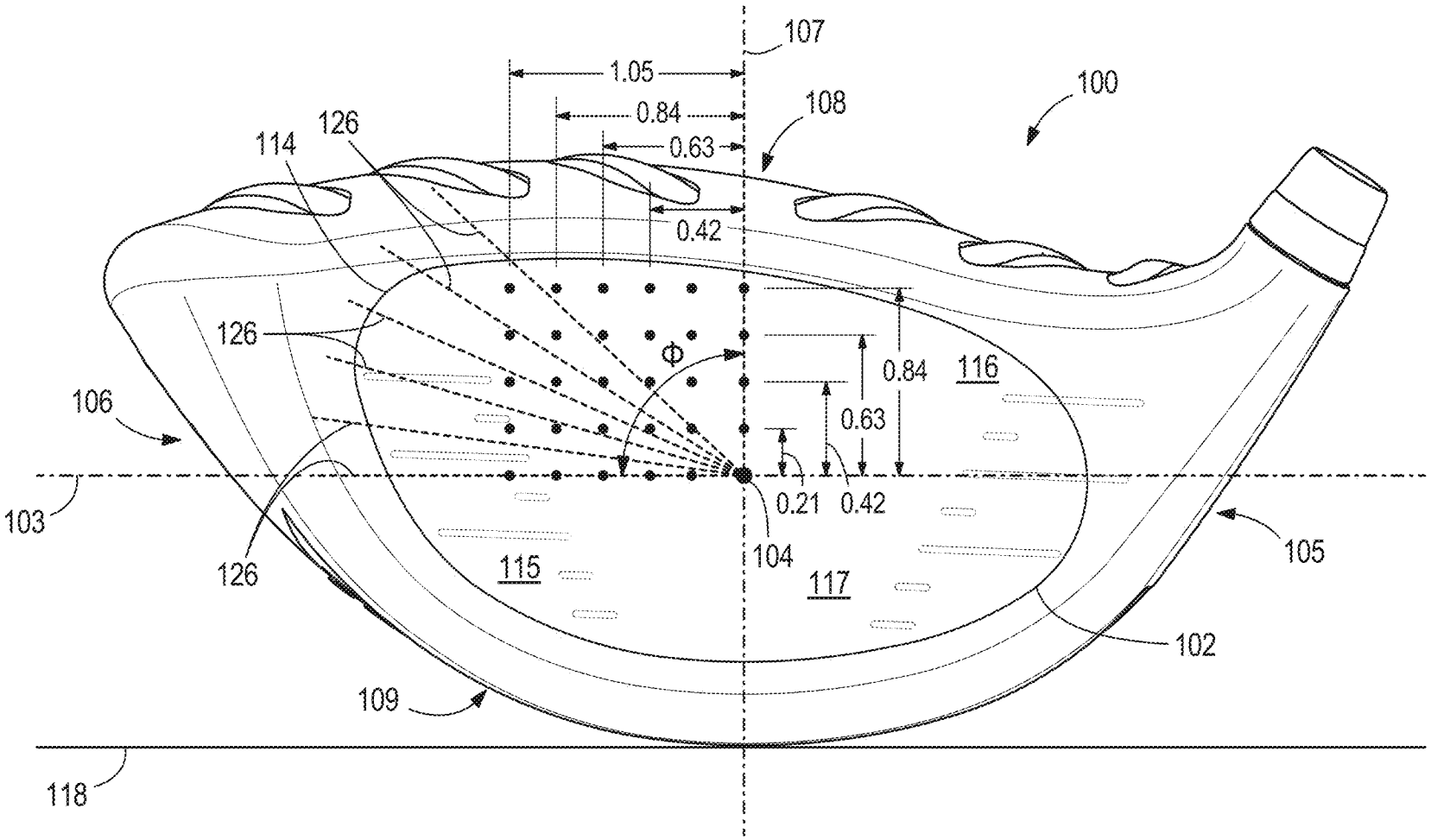
FIG. 5 illustrates a front view of a golf club head in an address position with a plurality of linear reference shapes.

As illustrated by FIG. 5, in many embodiments, the reference shape that includes an area of focus (i.e. one or more faceplate CT measurements that meets or exceeds a designed CT parameter) can be substantially linear. The reference shape, and more particularly, the linear shape 126 can extend from the geometric center 104 of the faceplate 102 to a point within the center-to-high toe quadrant 114. In many embodiments, one or more HAZ zones (or weld beads) are applied along the linear reference shape 126.

In many embodiments, the linear reference shape 126 can be at an angle relative to the x-axis 103. The angle between the linear reference shape 126 and the x-axis 103 can be between 20 degrees and 80 degrees. In many embodiments, the angle formed between the linear reference shape 126 and the x-axis can vary based upon the location of focus. In some embodiments, the angle formed between the linear reference shape 126 and the x-axis 103 can be between approximately 20 degrees-approximately 25 degrees, approximately 30 degrees-approximately 35 degrees, approximately 35 degrees-approximately 40 degrees, approximately 40 degrees to approximately 45 degrees, approximately 45 degrees-approximately 50 degrees, approximately 50 degrees to approximately 55 degrees, approximately 55 degrees to approximately 60 degrees, approximately 60 degrees to approximately 65 degrees, approximately 65 degrees to approximately 70 degrees, approximately 70 degrees to approximately 75 degrees, or approximately 75 degrees to approximately 80 degrees. In many embodiments, the formed angle can be approximately 45 degrees.

The linear reference shape 126 can have a height measured within the loft plane, in a crown to sole direction that can have a maximum height between approximately 5% and approximately 50% of a total height of the faceplate 102. In many embodiments, the height of the linear reference shape can be between approximately 5%-approximately 10%, approximately 10%-approximately 15%, approximately 15%-approximately 20%, approximately 20%-approximately 25%, approximately 25%-approximately 30%, approximately 30%-approximately 35%, approximately 35%-approximately 40%, approximately 40%-approximately 45%, or approximately 45%-approximately 50% of the total height of the faceplate 102.

In alternative embodiments, the linear reference shape 126 can have a maximum height measured within the loft plane, in a crown-to-sole direction between approximately 0 inch and 1.05 inches. In many embodiments, the maximum height of the linear reference shape 126 can be between approximately 0 inch-approximately 0.25 inches, approximately 0.25 inches-approximately 0.5 inches, approximately 0.5 inches-approximately 0.75 inches, approximately 0.75 inches-1.00 inches, or approximately 1.00 inches to approximately 1.05 inches. In other embodiments, the maximum height of the linear reference shape 126 can be greater than approximately 0 inches, greater than approximately 0.25 inches, greater than approximately 0.5 inches, greater than approximately 0.75 inches, or greater than approximately 1.0 inch. In alternative embodiments, the maximum height of the linear reference shape 126 can be less than approximately 1.05 inches, less than approximately 1.0 inch, less than approximately 0.75 inches, less than approximately 0.5 inches, or less than approximately 0.25 inches.

The linear reference shape 126 can have a maximum width measured within the loft plane, in a heel to toe direction that can be between approximately 5% and approximately 25% of a total width of the faceplate 102. In many embodiments, the width of the linear reference shape 126 can be between approximately 5%-approximately 10%, approximately 10%-approximately 15%, approximately 15%-approximately 20%, or approximately 20%-approximately 25 of the total width of the faceplate 102.

In alternative embodiments, the linear reference shape 126 can have a maximum width measured within the loft plane, in a heel-to-toe direction between approximately 0 inch and 1.05 inches. In many embodiments, the maximum width of the linear reference shape 126 can be between approximately 0 inch-approximately 0.25 inches, approximately 0.25 inches-approximately 0.5 inches, approximately 0.5 inches-approximately 0.75 inches, approximately 0.75 inches-1.00 inches, or approximately 1.00 inches to approximately 1.05 inches. In other embodiments, the maximum width of the linear reference shape 126 can be greater than approximately 0 inches, greater than approximately 0.25 inches, greater than approximately 0.5 inches, greater than approximately 0.75 inches, or greater than approximately 1 inch. In alternative embodiments, the maximum width of the linear reference shape 126 can be less than approximately 1.05 inches, less than approximately 1.0 inch, less than approximately 0.75 inches, less than approximately 0.5 inches, or less than approximately 0.25 inches.

As previously mentioned, the above described reference shapes 126 are projected onto the faceplate 102 to create a border around an area of interest. These areas of interest are typically areas where CT values are high, which generally can be found in the center-to-high toe quadrant 114. Within the center-to-high toe quadrant 114 and with specific reference to FIG. 2 and Table 1, it can be seen that at predetermined measurement location points (i.e. CT measurement regions), the CT can vary as much as approximately 15 μs within a one inch by one inch region. Further, at adjacent faceplate location points, the CT can vary by as much as 11 μs. This variability can further increase overtime with repeated impacts (i.e. wear). To reduce variability, within a localized region without effecting adjacent measurement locations HAZ zones can be formed via spot welding and/or a weld bead within or bordering a reference shape 126.

Reference Shape with One or More HAZ Zones

As discussed above, a heat affected zone can be found in one or more areas of the faceplate, and further the heat affected zone can border or be entirely located within a reference shape. Depositing a weld bead or spot weld within the reference shape creates a HAZ region forming a dendritic microstructure (different from non-spot-welded areas). In areas, where CT properties are at or above a threshold value, placing a spot weld at location(s) of concern, results in a CT reduction due to the dendritic microstructure properties. The reference shape can more easily assist an individual with identifying a location of CT correction, as it creates an outline around and/or over the area targeted for CT adjustment.

As discussed above, a HAZ zone is an area caused by a weld bead that alters the microstructure of the faceplate. As illustrated in FIG. 6, two spots welds (i.e. a first spot weld can also be referred to as a "first weld bead" and a second spot weld can also be referred to as a "second weld bead" are formed on the exterior surface of the faceplate 102. In other words, the first spot weld 119 and the second spot weld 120 can be applied to the (exterior) surface of the faceplate 102 that directly contacts a golf ball during impact. In other embodiments, the first and second spot welds 119, 120 not need to be formed/applied to the exterior surface of the faceplate 102, rather the first and second spot welds 119, 120 can be applied to the rear surface of the faceplate 102 in an open crown or open sole design (i.e. the body of the golf club head provides access to the interior of the club head). In many embodiments, the first spot weld 119 can be located at the geometric center of the faceplate and the second spot weld 120 is spaced from the geometric center and solely located in the center-to-high toe quadrant.

As previously mentioned, the one or more spot welds locally effect the microstructure of a certain region on the faceplate 102 without globally altering the microstructure of the entire faceplate 102. The one or more spot welds of FIG. 6 can be generally defined by a diameter. The diameter of one or more spot welds in contact with the faceplate 102 can be between approximately 0.125 inches and approximately 0.75 inches. In many embodiments, the diameter of the one or more spot welds can be between approximately 0.125 inches-approximately 0.225 inches, approximately 0.225 inches-approximately 0.325 inches, approximately 0.325 inches-approximately 0.425 inches, approximately 0.425 inches-approximately 0.525 inches, approximately 0.525 inches-approximately 0.625 inches, or approximately 0.625 inches-approximately 0.75 inches. In other embodiments, the diameter of the one or more spot welds can be approximately 0.1 inches, 0.150 inches, 0.2 inches, 0.250 inches, 0.3 inches, 0.350 inches, 0.4 inches, 0.450 inches, 0.5 inches, 0.550 inches, 0.6 inches, 0.650 inches, 0.7 inches, or 0.750 inches. In alternative embodiments, the diameter of the one or more spot welds can be less than approximately 0.750 inches, less than approximately 0.7 inches, less than approximately 0.65 inches, less than 0.6 inches, less than approximately 0.55 inches, less than approximately 0.50 inches, less than approximately 0.45 inches, less than approximately 0.40 inches, less than approximately 0.35 inches, less than approximately 0.30 inches, less than approximately 0.20 inches, or less than approximately 0.15 inches.

Figure 9:
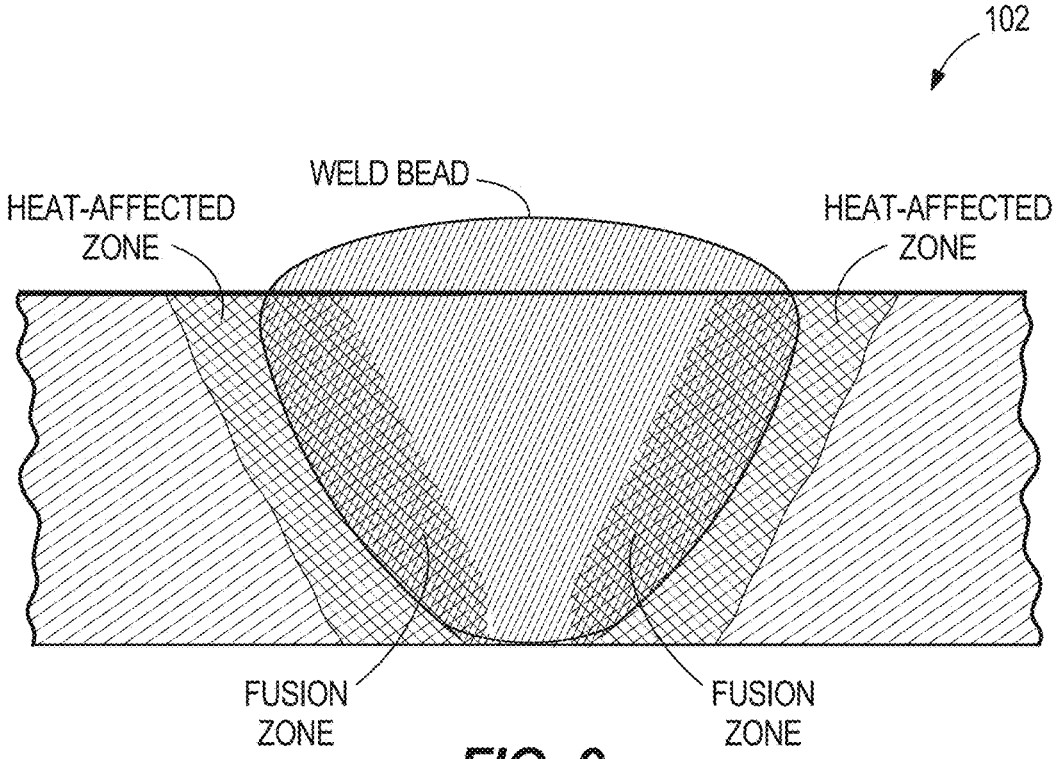
FIG. 9 illustrates some structural aspects of an exemplary structure and/or embodiment of a HAZ zone.

The heat affected zone formed by the spot weld can be between approximately 20% and approximately 50% of the diameter of the spot weld. In many embodiments, the spot weld can form a heat affected zone (i.e. where the microstructure changes) between approximately 20%-approximately 25%, approximately 25%-approximately 30%, approximately 30%-approximately 35%, approximately 35%-approximately 40%, approximately 40%-approximately 45%, approximately 45%-approximately 50% of the diameter of the spot weld. In other embodiments, the spot weld can form a heat affected zone less than approximately 50%, less than approximately 45%, less than approximately 40%, less than approximately 35%, less than approximately 30%, or less than approximately 25% of the diameter of the spot weld. The heat affected zone is a non-melted area of the faceplate 102 that has undergone microstructure changes as a result of portions of the metal matrix being exposed to high welding temperatures. The remaining area of the spot weld can be defined as the weld pool area (i.e. the area where the faceplate 102 has reached its melting point and may be ready to be infused with a filler material), and by way of example shown in FIG. 9. FIG. 9 is merely to exemplify a reference between the weld bead (or spot weld) and the HAZ zone. The weld bead can be placed on the exterior of the faceplate surface via heating. The bead portion is removed via a finishing technique (sanding, grinding, polishing, or the like) but the formed HAZ zones are still readily present in the structure.

As previously mentioned, FIG. 6 illustrates the first spot weld 119 and the second spot weld 120 applied to the faceplate 102 to locally change the microstructure of the faceplate 102 within the heat effected zone mentioned above. The microstructure of the heat effected zone caused by the spot weld forms a dendrite structure that are needle-like or finger-like structures that produce smaller grain boundaries to stiffen or increase the faceplate strength in the welded (or HAZ) region. This localized stiffening directly correlates to a decrease in characteristic time of that region as faceplate flexibility is limited. The locations outside of the weld pool and heat effected zones (i.e. locations unaffected by the spot weld) have a homogenous microstructure with larger grain boundaries relative to the grain boundaries of the heat affected zone(s). In many embodiments, the HAZ structure defined by the spot weld creates a faceplate having a 2% to 6% increase in dendrite microstructures compared to non-spot-welded faceplates.

In this specific the embodiment, the first spot weld 119 and the second spot weld are located on and/or within a reference shape 126 discussed above, spaced, and do not touch each other. In many embodiments, the center of the first spot weld 119 and the center of the second spot weld 120 are spaced between approximately 0.1 inches and 1 inch. For example, in many embodiments, the center of the first spot weld 119 and the center of the second spot weld 120 can be spaced from each other by 0.1 inches, 0.15 inches, 0.2 inches, 0.25 inches, 0.3 inches, 0.35 inches, 0.4 inches, 0.45 inches, 0.5 inches, 0.55 inches, 0.60 inches, 0.65 inches, 0.70 inches, 0.75 inches, 0.80 inches, 0.85 inches, 0.90 inches, 0.95 inches, or 1.0 inch. In other embodiments, the spacing distance between the center of the first spot weld and the center of the second spot weld 120 can be less than 1.0 inch, less than 0.95 inch, less than 0.90 inch, less than 0.85 inch, less than 0.80 inch, less than 0.75 inch, less than 0.70 inch, less than 0.65 inch, less than 0.60 inch, less than 0.55 inch, less than 0.50 inch, less than 0.45 inch, less than 0.40 inch, less than 0.35 inch, less than 0.30 inch, less than 0.20 inch, or less than 0.150 inch.

In many embodiments, the second spot weld 120 can be offset from the geometric center along the X-axis and/or towards the toe by up to approximately 0.84 inches. In alternative embodiments, the second spot weld 120 can be offset from the geometric center along the X-axis direction, and/or towards the toe by approximately 0.01 inches, 0.02 inches, 0.03 inches, 0.04 inches, 0.05 inches, 0.06 inches, 0.07 inches, 0.08 inches, 0.09 inches, 0.10 inches, 0.11 inches, 0.12 inches, 0.13 inches, 0.14 inches, 0.15 inches, 0.16 inches, 0.17 inches, 0.18 inches, 0.19 inches, 0.20 inches, 0.21 inches, 0.22 inches, 0.23 inches, 0.24 inches, 0.25 inches, 0.26 inches, 0.27 inches, 0.28 inches, 0.29 inches, 0.30 inches, 0.31 inches, 0.32 inches, 0.33 inches, 0.34 inches, 0.35 inches, 0.36 inches, 0.37 inches, 0.38 inches, 0.39 inches, 0.40 inches, 0.41 inches, 0.42 inches, 0.43 inches, 0.44 inches, 0.45 inches, 0.46 inches, 0.47 inches, 0.48 inches, 0.49 inches, 0.50 inches, 0.51 inches, 0.52 inches, 0.53 inches, 0.54 inches, 0.55 inches, 0.56 inches, 0.57 inches, 0.58 inches, 0.59 inches, 0.60 inches, 0.61 inches, 0.62 inches, 0.63 inches, 0.64 inches, 0.65 inches, 0.66 inches, 0.67 inches, 0.68 inches, 0.69 inches, 0.70 inches, 0.71 inches, 0.72 inches, 0.73 inches, 0.74 inches, 0.75 inches, 0.76 inches, 0.77 inches, 0.78 inches, 0.79 inches, 0.80 inches, 0.81 inches, 0.82 inches, 0.83 inches, or 0.84 inches.

In the same or other embodiments, the second spot weld 120 can be offset from the geometric center towards the crown or top end of the face plate by up to approximately 0.42 inches. The second spot weld 120 can be offset from the geometric center along the Y-axis direction, and/or towards the crown by approximately 0.01 inches, 0.02 inches, 0.03 inches, 0.04 inches, 0.05 inches, 0.06 inches, 0.07 inches, 0.08 inches, 0.09 inches, 0.10 inches, 0.11 inches, 0.12 inches, 0.13 inches, 0.14 inches, 0.15 inches, 0.16 inches, 0.17 inches, 0.18 inches, 0.19 inches, 0.20 inches, 0.21 inches, 0.22 inches, 0.23 inches, 0.24 inches, 0.25 inches, 0.26 inches, 0.27 inches, 0.28 inches, 0.29 inches, 0.30 inches, 0.31 inches, 0.32 inches, 0.33 inches, 0.34 inches, 0.35 inches, 0.36 inches, 0.37 inches, 0.38 inches, 0.39 inches, 0.40 inches, 0.41 inches, or 0.42 inches. In many embodiments, the first and second spot welds are spaced from and do not contact or engage the face-to-body transition region.

In many embodiments, as illustrated in FIG. 6, the first spot weld 119 and the second spot weld 120 are colinear to each other. In alternative embodiments, the first spot weld 119 and the second spot weld need not to be colinear. Based on the faceplate surface area of the club head illustrated, approximately 0.5% to 1.0% of the surface area of the faceplate can be contacted by a single weld bead. No more than 16.5% of the external faceplate surface area can be in contact with any weld.

Linear Reference Shape with One or More HAZ Zones

A heat affected zone can be found in a certain area of the faceplate, and further the heat affected zone can either border or be entirely located within a reference shape. Depositing a weld bead or spot weld within the reference shape creates a HAZ region forming a dendritic microstructure (different from non-spot-welded areas). In areas, where CT properties are at or above a threshold value, placing a spot weld at location(s) of concern, results in a CT reduction due to the dendritic microstructure properties. The reference shape can more easily assist an individual with identifying a location of CT correction, as it creates an outline around and/or over the area targeted for CT adjustment.

As mentioned above, HAZ zone(s) can also be linearly placed along a reference shape. As described above, reference shapes 126 can be projected onto the faceplate 102, and more particularly a linear reference shape 126 can be projected over a plurality of interest points on the faceplate 102. These points of interest are typically areas where CT values are high, which generally can be found in the center-to-high toe quadrant 114. Within the center-to-high toe quadrant 114 and with specific reference to the below example, it can be seen that at faceplate measurement location points (i.e CT measurement regions), the CT can vary as much as approximately 15 μs with in a one inch by one inch region. Further, at adjacent faceplate location points, the CT can vary by as much as 11 μs. This variability can further increase overtime with repeated impacts (i.e. wear). To reduce variability, within a localized region without effecting adjacent measurement locations HAZ zones can be formed via spot welding and/or a weld bead.

Figure 7:
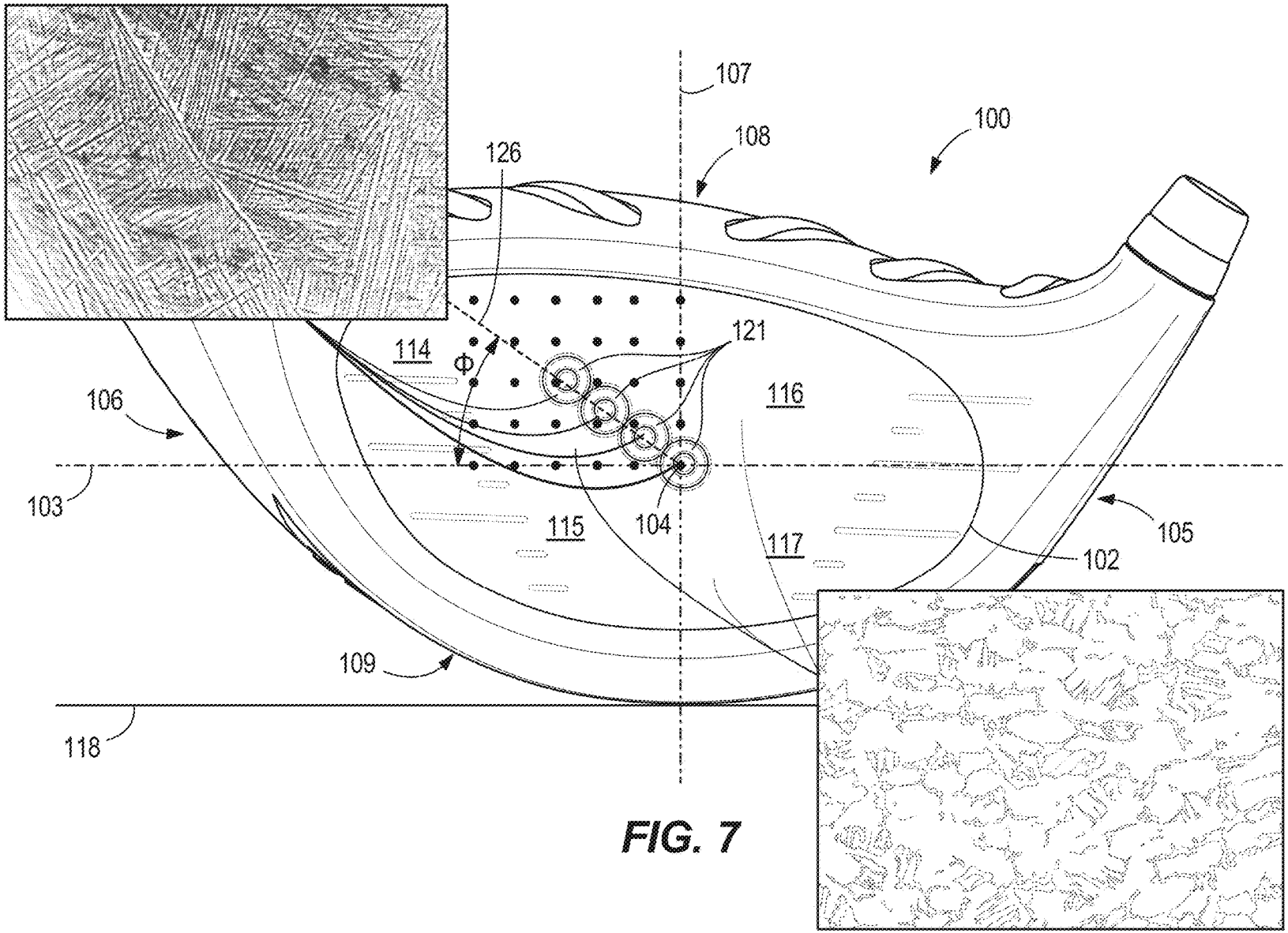
FIG. 7 illustrates a front view of a golf club head in an address position with a linear reference shape and one or more HAZ zones.

As illustrated in FIG. 7, a plurality of spots welds 121 (i.e. a plurality of spot welds can also be referred to as a "a plurality of weld beads" are formed on the exterior surface of the faceplate 102. In other words, the plurality of spot welds 121 can be applied to the (exterior) surface of the faceplate 102 that directly contacts a golf ball during impact. In other embodiments, the plurality of spot welds 121 not need to be formed/applied to the exterior surface of the faceplate 102, rather the plurality of spot welds 121 can be applied to the rear surface of the faceplate 102 in an open crown or open sole design (i.e. the body of the golf club head provides access to the interior of the club head).

In many embodiments, the plurality of spot welds can be referred to as two or more spot welds, three or more spot welds, four or more spot welds, five or more spot welds, six or more spot welds, seven or more spot welds, eight or more spot welds, nine or more spot welds, ten or more spot welds, eleven or more spot welds, or twelve or more spot welds. The plurality of spot welds can generally be formed along the linear reference shape. In some embodiments, due to precision error the plurality of spot welds can be slightly offset from the linear reference shape 126.

As previously mentioned, the plurality of spot welds 121 locally effect the microstructure of a certain region on the faceplate 102 without globally altering the microstructure of the entire faceplate 102. The plurality of spot welds illustrated by FIG. 7 can be generally defined by a diameter. The diameter of the plurality of spot welds 121 in contact with the faceplate 102 can be between approximately 0.125 inches and approximately 0.75 inches. In many embodiments, the diameter of the plurality of spot welds can be between approximately 0.125 inches-approximately 0.225 inches, approximately 0.225 inches-approximately 0.325 inches, approximately 0.325 inches-approximately 0.425 inches, approximately 0.425 inches-approximately 0.525 inches, approximately 0.525 inches-approximately 0.625 inches, or approximately 0.625 inches-approximately 0.75 inches. In other embodiments, the diameter of the plurality of spot welds 121 can be approximately 0.1 inches, 0.150 inches, 0.2 inches, 0.250 inches, 0.3 inches, 0.350 inches, 0.4 inches, 0.450 inches, 0.5 inches, 0.550 inches, 0.6 inches, 0.650 inches, 0.7 inches, or 0.750 inches. In alternative embodiments, the diameter of the plurality of spot welds 121 can be less than approximately 0.750 inches, less than approximately 0.7 inches, less than approximately 0.65 inches, less than 0.6 inches, less than approximately 0.55 inches, less than approximately 0.50 inches, less than approximately 0.45 inches, less than approximately 0.40 inches, less than approximately 0.35 inches, less than approximately 0.30 inches, less than approximately 0.20 inches, or less than approximately 0.15 inches.

The heat affected zone formed by the plurality of spot welds 121 can be between approximately 20% and approximately 50% of each diameter of the plurality of spot welds. In many embodiments, the spot weld can form a heat affected zone (i.e. where the microstructure changes) between approximately 20%-approximately 25%, approximately 25%-approximately 30%, approximately 30%-approximately 35%, approximately 35%-approximately 40%, approximately 40%-approximately 45%, approximately 45%-approximately 50% of the diameter of the spot weld. In other embodiments, the plurality of spot welds 121 can form a heat affected zone less than approximately 50%, less than approximately 45%, less than approximately 40%, less than approximately 35%, less than approximately 30%, or less than approximately 25% of the diameter of the spot weld. The heat affected zone is a non-melted area of the faceplate 102 that has undergone microstructure changes as a result of being exposed to high welding temperatures. The remaining area of the spot weld can be defined as the weld pool area (i.e. the area where the faceplate 102 has reached its melting point and may be ready to be infused with a filler material), and by way of example shown in FIG. 9.

As further illustrated by FIG. 7 and discussed above, the plurality of spot welds formed on the faceplate 102 locally changes the microstructure of the faceplate 102 within the heat effected zone mentioned above. The microstructure of the heat effected zone caused by the spot weld forms a dendrite structure that are needle-like or finger-like structures that produce smaller grain boundaries sizes to stiffen or increase the strength of the faceplate 102 in the welded (or HAZ) region. This localized stiffening directly correlates to a decrease in characteristic time of that region as faceplate flexibility is reduced. The locations outside of the weld pool and heat effected zones (i.e. locations unaffected by the spot weld) have a homogenous microstructure with larger grain boundaries relative to the grain boundaries of the heat affected zones.

In this specific the embodiment, the plurality of spot welds 121 are located along the linear reference shape 126 and extend from the geometric center 104 of the faceplate 102 to a point within the center-to-high toe quadrant and does not extend into a body portion of the club head. In this exemplary embodiment, each of the plurality of spot welds 121 contact or touch another spot weld of the plurality of spot welds. In other embodiments, the plurality of spot welds need not to touch or contact another spot weld. In these embodiments, the plurality of spot welds can be spaced from each spot weld between approximately 0.1 inches and 1 inch. For example, in many embodiments, the plurality of spot welds can be spaced from one another by 0.1 inches, 0.15 inches, 0.2 inches, 0.25 inches, 0.3 inches, 0.35 inches, 0.4 inches, 0.45 inches, 0.5 inches, 0.55 inches, 0.60 inches, 0.65 inches, 0.70 inches, 0.75 inches, 0.80 inches, 0.85 inches, 0.90 inches, 0.95 inches, or 1.0 inch.

The furthest spot weld of the plurality of spot welds 121 from the geometric center (along the X-axis and/or towards the toe) can be spaced up to approximately 0.84 inches. In alternative embodiments, the furthest spot weld of the plurality of spot welds 121 can be spaced from the geometric center along the X-axis 103 direction, and/or towards the toe by approximately 0.01 inches, 0.02 inches, 0.03 inches, 0.04 inches, 0.05 inches, 0.06 inches, 0.07 inches, 0.08 inches, 0.09 inches, 0.10 inches, 0.11 inches, 0.12 inches, 0.13 inches, 0.14 inches, 0.15 inches, 0.16 inches, 0.17 inches, 0.18 inches, 0.19 inches, 0.20 inches, 0.21 inches, 0.22 inches, 0.23 inches, 0.24 inches, 0.25 inches, 0.26 inches, 0.27 inches, 0.28 inches, 0.29 inches, 0.30 inches, 0.31 inches, 0.32 inches, 0.33 inches, 0.34 inches, 0.35 inches, 0.36 inches, 0.37 inches, 0.38 inches, 0.39 inches, 0.40 inches, 0.41 inches, 0.42 inches, 0.43 inches, 0.44 inches, 0.45 inches, 0.46 inches, 0.47 inches, 0.48 inches, 0.49 inches, 0.50 inches, 0.51 inches, 0.52 inches, 0.53 inches, 0.54 inches, 0.55 inches, 0.56 inches, 0.57 inches, 0.58 inches, 0.59 inches, 0.60 inches, 0.61 inches, 0.62 inches, 0.63 inches, 0.64 inches, 0.65 inches, 0.66 inches, 0.67 inches, 0.68 inches, 0.69 inches, 0.70 inches, 0.71 inches, 0.72 inches, 0.73 inches, 0.74 inches, 0.75 inches, 0.76 inches, 0.77 inches, 0.78 inches, 0.79 inches, 0.80 inches, 0.81 inches, 0.82 inches, 0.83 inches, or 0.84 inches.

In the same or other embodiments, the furthest spot weld of the plurality of spot welds 121 from the geometric center, along the Y-axis 107 can be spaced from the geometric center towards the crown or top end of the face plate by up to approximately 0.42 inches. The furthest spot weld can be spaced from the geometric center along the Y-axis direction, and/or towards the crown by approximately 0.01 inches, 0.02 inches, 0.03 inches, 0.04 inches, 0.05 inches, 0.06 inches, 0.07 inches, 0.08 inches, 0.09 inches, 0.10 inches, 0.11 inches, 0.12 inches, 0.13 inches, 0.14 inches, 0.15 inches, 0.16 inches, 0.17 inches, 0.18 inches, 0.19 inches, 0.20 inches, 0.21 inches, 0.22 inches, 0.23 inches, 0.24 inches, 0.25 inches, 0.26 inches, 0.27 inches, 0.28 inches, 0.29 inches, 0.30 inches, 0.31 inches, 0.32 inches, 0.33 inches, 0.34 inches, 0.35 inches, 0.36 inches, 0.37 inches, 0.38 inches, 0.39 inches, 0.40 inches, 0.41 inches, or 0.42 inches. In many embodiments, the plurality of spot welds 121 are spaced from and do not contact or engage the face-to-body transition region.

In many embodiments, as illustrated in FIG. 7, the plurality of spot welds are colinear to each other. In alternative embodiments, the plurality of spot welds need not to be colinear and slightly offset from the linear reference line (i.e. noncolinear) Based on the faceplate surface area of the club head illustrated in the exemplary embodiment of FIG. 7, approximately 0.5% to 1.0% of the surface area of the faceplate can be contacted by a single weld bead. No more than 16.5% of the external faceplate surface area can be in contact with any weld.

Rectangle Reference Shape with One or More HAZ Zones

Heat affected zone(s) can be found in certain area(s) of the faceplate, and further the heat affected zone can border or be entirely located within a reference shape 126. Depositing a weld bead or spot weld within the reference shape 126 creates a HAZ region forming a dendritic microstructure (different from non-spot-welded areas). In areas, where CT properties are at or above a threshold value, placing a spot weld at location(s) of concern, results in a CT reduction due to the dendritic microstructure properties. The reference shape 126 can more easily assist an individual with identifying a location of CT correction, as it creates an outline around and/or over the area targeted for CT adjustment.

As previously mentioned, reference shapes 126 are projected onto the faceplate 102 to create a border around an area of interest. These areas of interest are typically areas where CT values are high, which generally can be found in the center-to-high toe quadrant 114. Within the center-to-high toe quadrant 114 and with specific reference to FIG. 2, it can be seen that at faceplate location points (i.e. CT measurement regions), the CT can vary as much as approximately 15 μs within a one inch by one inch region. Further, at adjacent faceplate location points, the CT can vary by as much as 11 μs. This variability can further increase overtime with repeated impacts (i.e. wear). To reduce variability, within a localized region without effecting adjacent measurement locations HAZ zones can be formed via spot welding and/or a weld bead.

Figure 8:
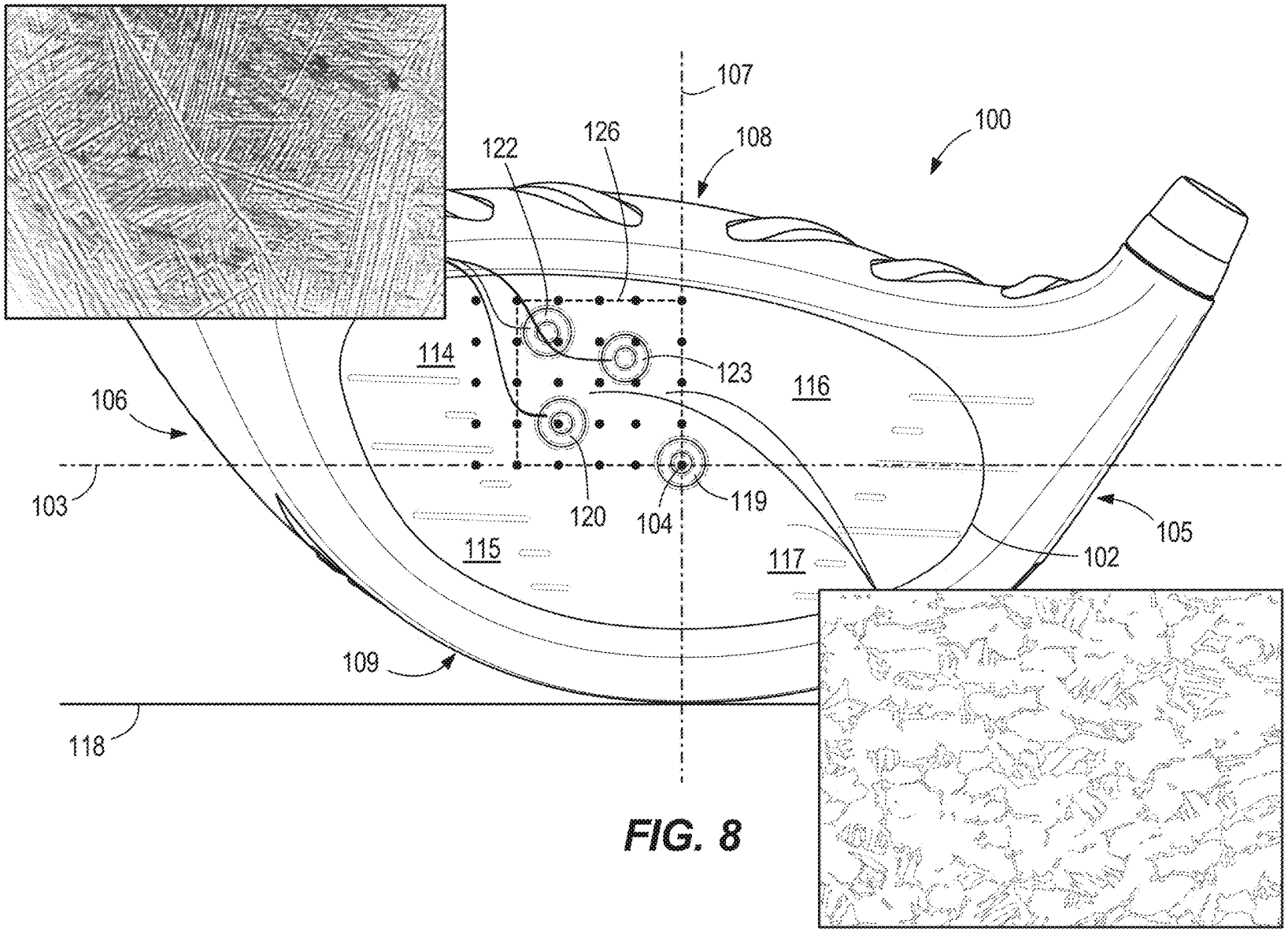
FIG. 8 illustrates a front view of a golf club head in an address position with a rectangular reference shape and one or more HAZ zones.

As illustrated in FIG. 8, at least four spots welds (i.e. a first spot weld 119, second spot weld 120, third spot weld 122, and fourth spot weld 123 can also be referred to as a first weld bead, a second weld bead, a third weld bead, and a fourth weld bead, respectively) are formed on the exterior surface of the faceplate 102. In other words, the first spot weld 119, the second spot weld 120, the third spot weld 122, and the fourth spot weld 123 can be applied to the (exterior) surface of the faceplate 102 that directly contacts a golf ball during impact. In other embodiments, the first, second, third and fourth spot welds 119, 120, 122, 123 not need to be formed/applied to the exterior surface of the faceplate 102, rather the first, second, third, and fourth spot welds 119, 120, 122, and 123 can be applied to the rear surface of the faceplate 102 in an open crown or open sole design (i.e. the golf club head provides access to the interior of the club head).

As previously discussed, the spot welds 119, 120, 122, and 123 can locally affect the microstructure of a certain region on the faceplate 102 without globally altering the microstructure of the entire faceplate 102. The four or more spot welds exemplified in FIG. 8 can be generally defined by a diameter. The diameter of four or more spot welds 119, 120, 122, and 123 in contact with the faceplate 102 can be between approximately 0.125 inches and approximately 0.75 inches. In many embodiments, the diameter of the one or more spot welds can be between approximately 0.125 inches-approximately 0.225 inches, approximately 0.225 inches-approximately 0.325 inches, approximately 0.325 inches-approximately 0.425 inches, approximately 0.425 inches-approximately 0.525 inches, approximately 0.525 inches-approximately 0.625 inches, or approximately 0.625 inches-approximately 0.75 inches. In other embodiments, the diameter of the four or more spot welds can be approximately 0.1 inches, 0.150 inches, 0.2 inches, 0.250 inches, 0.3 inches, 0.350 inches, 0.4 inches, 0.450 inches, 0.5 inches, 0.550 inches, 0.6 inches, 0.650 inches, 0.7 inches, or 0.750 inches. In alternative embodiments, the diameter of the four or more spot welds can be less than approximately 0.750 inches, less than approximately 0.7 inches, less than approximately 0.65 inches, less than 0.6 inches, less than approximately 0.55 inches, less than approximately 0.50 inches, less than approximately 0.45 inches, less than approximately 0.40 inches, less than approximately 0.35 inches, less than approximately 0.30 inches, less than approximately 0.20 inches, or less than approximately 0.15 inches.

The heat affected zone formed by a single spot weld can be between approximately 20% and approximately 50% of the diameter of the spot weld. In many embodiments, the spot weld can form a heat affected zone (i.e. where the microstructure changes) between approximately 20%-approximately 25%, approximately 25%-approximately 30%, approximately 30%-approximately 35%, approximately 35%-approximately 40%, approximately 40%-approximately 45%, approximately 45%-approximately 50% of the diameter of the spot weld. In other embodiments, the spot weld can form a heat affected zone less than approximately 50%, less than approximately 45%, less than approximately 40%, less than approximately 35%, less than approximately 30%, or less than approximately 25% of the diameter of the spot weld. The heat affected zone is a non-melted area of the faceplate 102 that has undergone microstructure changes as a result of being exposed to high welding temperatures. The remaining area of the spot weld can be defined as the weld pool area (i.e. the area where the faceplate 102 has reached its melting point and may be ready to be infused with a filler material), and by way of example shown in FIG. 9.

As further illustrated by FIG. 8, the first spot weld 119, the second spot weld 120, the third spot weld 122, and the fourth spot weld 123 formed on the faceplate 102 locally changes the microstructure of the faceplate 102 within the heat effected zone mentioned above. The microstructure of the heat effected zone caused by the spot weld forms a dendrite structure that are needle-like or finger-like structures that produce smaller grain boundaries to stiffen or increase the strength in the welded (or HAZ) region of the faceplate 102. This localized stiffening directly correlates to a decrease in characteristic time of that region as faceplate flexibility is reduced. The locations outside of the weld pool and heat effected zones (i.e. locations unaffected by the spot weld) have a homogenous microstructure with larger grain boundaries relative to the grain boundaries of the heat affected zones (i.e. less stiffer regions, more flexibility).

In this specific the embodiment, the first spot weld 119, the second spot weld 120, the third spot weld 122, and the fourth spot weld 123 are located on and/or within a rectangular reference shape 126, at locations of interest, and can be spaced from one another and do not touch each other. In many embodiments, the spacing distance between the center of the first spot weld 119, the center of the second spot weld 120, the center of the third spot weld 122, and the center of the fourth spot weld 123 can vary. In many embodiments, the spacing distance can be between approximately 0.1 inches and 1 inch. For example, in many embodiments, the center of the first spot weld 119 to at least one of the center of the second spot weld 120, the center of the third spot weld 122, and the center of the fourth spot weld 123 can be spaced from each other by 0.1 inches, 0.15 inches, 0.2 inches, 0.25 inches, 0.3 inches, 0.35 inches, 0.4 inches, 0.45 inches, 0.5 inches, 0.55 inches, 0.60 inches, 0.65 inches, 0.70 inches, 0.75 inches, 0.80 inches, 0.85 inches, 0.90 inches, 0.95 inches, or 1.0 inch. In other embodiments, the spacing distance between the center of the first spot weld 119 and at least one of the center second spot weld 120, the center of the third spot weld 122, and the center of the fourth spot weld 123 can be less than 1.0 inch, less than 0.95 inch, less than 0.90 inch, less than 0.85 inch, less than 0.80 inch, less than 0.75 inch, less than 0.70 inch, less than 0.65 inch, less than 0.60 inch, less than 0.55 inch, less than 0.50 inch, less than 0.45 inch, less than 0.40 inch, less than 0.35 inch, less than 0.30 inch, less than 0.20 inch, or less than 0.150 inch. In many embodiments, the first, second, third, and fourth spot welds are spaced from and do not contact or engage the face-to-body transition region.

In many embodiments, as illustrated in FIG. 8, at least two spot welds are colinear with each other. In the same or alternative embodiments, at least two spots welds are not colinear with each other. Based on the faceplate surface area of the club head illustrated in the examples of FIG. 8, approximately 0.5% to 1.0% of the surface area of the faceplate can be contacted by a single weld bead. No more than 16.5% of the external faceplate surface area can be in contact with any weld.

Method of Manufacturing

Figure 10:
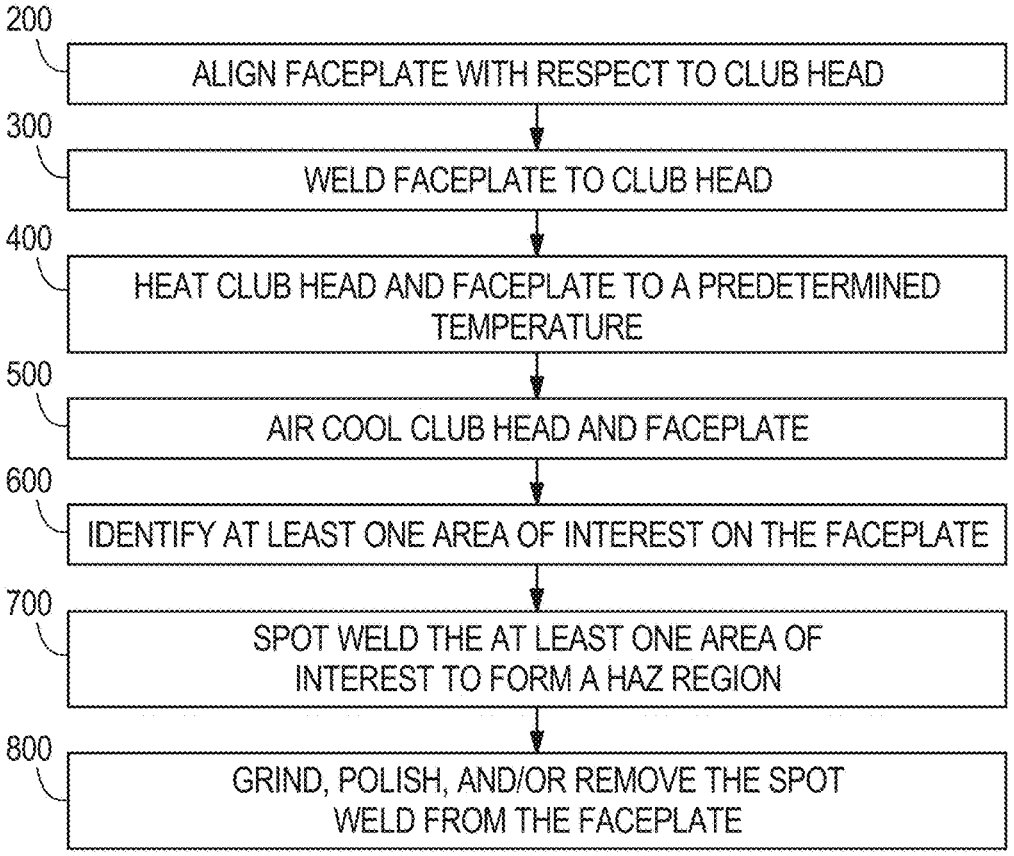
FIG. 10 is a schematic view of a process for forming a golf club head assembly.

FIG. 10 shows the process for forming and/or assembling the golf club head 100. In the first step 200, the faceplate 102 can be aligned with respect to the body of the golf club head 100. The second step 300 involves welding the faceplate 102 to the body of the club head 100. In the third step 400, the club head and the faceplate can be heated to a temperature at, above, or below the solvus temperature of the faceplate material through a series of solution and/or aging steps. In the fourth step 500, the club head and the faceplate are air cooled.

Once the club head is cooled, the fifth step 600 involves identifying at least one area of interest on the face plate. This area(s) of interest can typically be identified or found by determining locations where the golf ball stays on the faceplate at impact for a period of time longer than intentionally designed. The locations can be identified or found by (1) the standard USGA test method for measuring characteristic time via a heat seeking process (which looks to identify the location and value of the greatest characteristic time value(s) of a club head by taking measurements at strategically chosen locations) or (2) by identifying a known area of concern through a club head aggregation of CT data.

Upon at least one area of interest on the faceplate being identified, a spot weld via plasma welding or laser welding can be applied to the at least one area of interest at a predetermined temperature between 500 degrees Celsius and 650 degrees Celsius for a time span between one second and five seconds, thereby forming a HAZ region. This step 700 can be completed prior to any faceplate finishing steps. For example, the localized heat treatment can be completed prior to a smoothing or texturing processes, coating/aesthetic processes, and entire faceplate and/or club head heat polishing processes.

Finally, in the seventh step 800, the filler material formed by the spot weld can be grinded, smoothed and/or removed from the faceplate to create a smooth faceplate surface. In other words, the excess material on the faceplate as a result of the spot weld can be removed prior to polishing so that no mass is added to the faceplate. After removal of the spot weld as discussed above, from a macroscopic view the faceplate appears to unaltered, however, from a microscopic view portions of the faceplate microstructure are altered to have a dendrite structure.

Example 1

A three-club robotic test experiment was conducted to analyze the effectiveness of the golf club head embodiments described herein to obtain quantifiable information with regards to club head characteristic time, ball speed, launch angle, and spin properties. Specifically, the embodiment of FIG. 7 was benchmarked against a control club without a HAZ zone and a control club without a HAZ zone being delofted one degree.

The tested golf club head of FIG. 7 was a driver-type golf club head with a loft angle of approximately 8.95 degrees, a swing weight of D4.2, a total club head weight (grip+shaft+head) of 317.9 grams, and a finished head weight of 204.5 grams. The control club was a driver-type golf club head with a loft angle of approximately 9.1 degrees, a swing weight of D4.1, a total club head weight (grip+shaft+head) of 317.6 grams, and a finished head weight of 204.6 grams.

The one-degree delofted control club was delofted (via an adjustable hosel) to have a club head with a loft angle of approximately 8.1 degrees, a swing weight of D4.1, a total club head weight (grip+shaft+head) of 317.6 grams, and a finished head weight of 204.6 grams.

Further, at various locations on the control club, the center-to-high toe quadrant various characteristic time measurements were recorded. The below table (Table 1) summarizes the recorded values. The measurement location with the point location at (0 inch, 0 inch) is defined at the geometric center (or origin) of the golf club head. Moving right-to-left on the table, adjusts the horizontal reference position, therefore moving closer to the toe of the club head. Moving from bottom-to-top on the table adjusts the vertical reference position, therefore moving towards the crown of the club head.

TABLE 1

| | | | | | |
|---|---|---|---|---|---|
| 0.84 inch | 238 us | N/A | 232 us | N/A | N/A |
| 0.63 inch | 234 us | 250 us | N/A | N/A | N/A |
| 0.42 inch | 253 us | 251 us | 245 us | 243 us | 233 us |
| 0.21 inch | 253 us | 253 us | 251 us | 254 us | 251 us |
| 0 inch | 244 us | 247 us | 248 us | 252 us | 253 us |
| | 0.84 inch | 0.63 inch | 0.42 inch | 0.21 inch | 0 inch |

For comparison purposes, in the tested embodiment of FIG. 7, the center-to-high toe characteristics time values were also measured and shown in Table 2. When comparing Table 1 and Table 2, it can be seen that at critical locations on the faceplate (i.e. the center to high-toe quadrant) the characteristic time measurements before spot welding (Table 1) and after spot welding (Table 2) decreased on average approximately 4% or 12 μs.

TABLE 2

| | | | | | |
|---|---|---|---|---|---|
| 0.84 inch | N/A | N/A | N/A | N/A | N/A |
| 0.63 inch | N/A | N/A | N/A | N/A | N/A |
| 0.42 inch | 241.4 us | 230.6 us | N/A | N/A | N/A |
| 0.21 inch | N/A | N/A | N/A | N/A | N/A |
| 0 inch | 240.7 us | N/A | 237.7 us | N/A | 241.4 us |
| | 0.84 inch | 0.63 inch | 0.42 inch | 0.21 inch | 0 inch |

Figure 11:
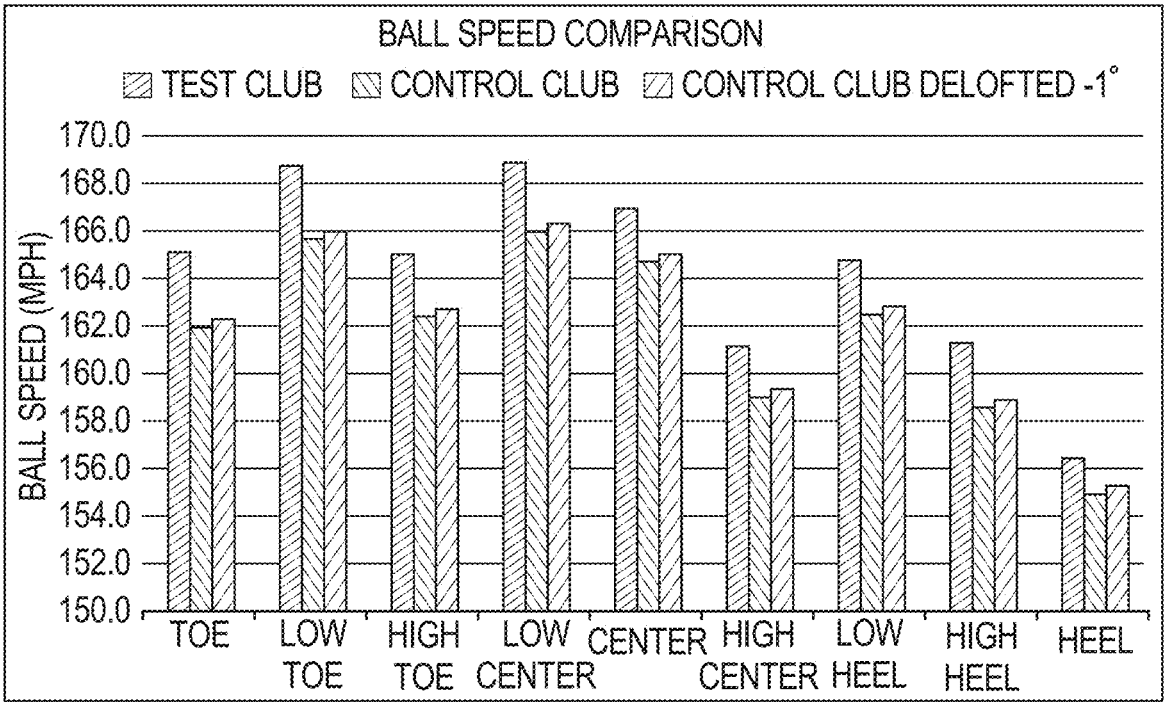
FIG. 11 is a chart comparing the ball speed (in miles per hour) for a test club with a HAZ zone, a control club without a HAZ zone, and a control club without a HAZ zone delofted by one degree.
Figure 12:
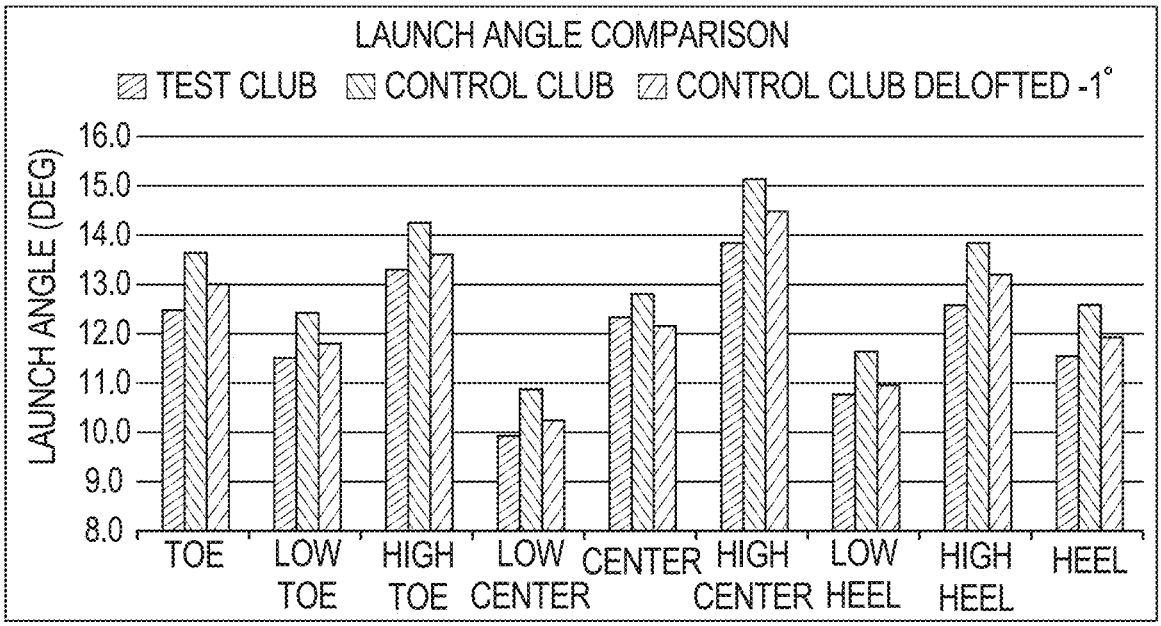
FIG. 12 is a chart comparing the launch angle for a test club having a HAZ zone, a control club without a HAZ zone, and a control club without a HAZ zone delofted by one degree.
Figure 13:
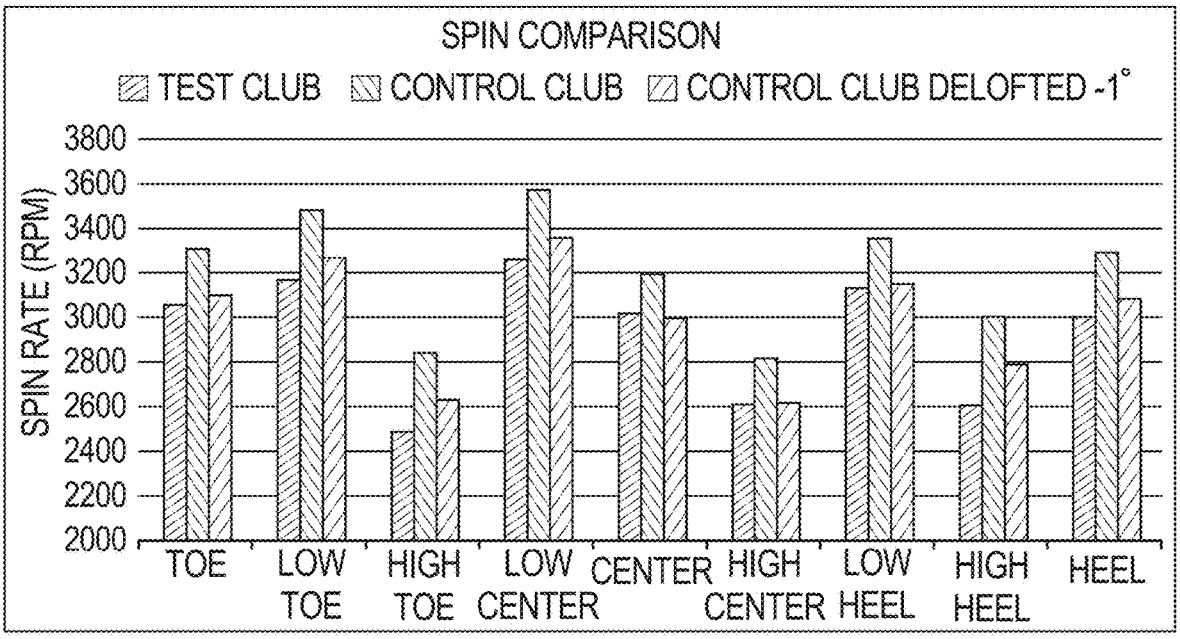
FIG. 13 is a chart comparing the spin rate (in rpm) for a test club having a HAZ zone, a control club without a HAZ zone, and a control club without a HAZ zone delofted by one degree.

Typically, a decrease in characteristic time results also results in decreased ball speeds. However, this was not the case. Specifically, referring to FIG. 11, it can be seen that across all center, toe, and heel impacts the ball speeds in the tested club increased over the control club, and the delofted control club. Further, in FIGS. 12 and 13, it can also be seen that the tested club head launched approximately 8% lower with approximately 9% lower spin.

It was concluded that this phenomenon was due both to impact speed and localized faceplate stiffening. Characteristic Time tests are low (or slow) impact tests that measures how long the golf ball stays in contact with the faceplate upon impact. Alternatively, ball speed data is typically captured at a high rate of impact with a golf ball. So, the club heads described herein with HAZ zones (and more particularly the faceplate response) varies according to low and high impact settings.

For example, at a characteristic time measurement location, where the heat affected zone is present, the heat affected zone is stiffer due to smaller grain boundaries than adjacent (non-HAZ locations). A stiffer region results in a decrease in CT (at the specified location) because the heat affected zone does not allow the faceplate to flex as much, so the golf ball will not stay in contact with faceplate as long upon impact. However, at high impacts (such as full swings), the heat affected zone produces increased ball speeds, as the system as a whole is stiffer, and thus energy transfer upon impact to the golf ball is not lost upon face flexure due to decreased face bending and/or flexure in the specified region.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

Various features and advantages of the disclosure are set forth in the following claims.

Clause 1. A golf club head comprising: a faceplate and a body, the body comprising a sole, a crown, a heel end, and a toe end; wherein: the sole is in a ground plane at address; the crown is opposite the sole; the heel end is opposite the toe end and perpendicular to the sole and the crown; the faceplate comprises a geometric center that is equidistant from the crown and the sole, and equidistant from the heel end and the toe end; and the faceplate defines a loft plane, wherein the loft plane intersects the ground plane and is tangent to the geometric center; a reference shape having a height and a width; wherein: the reference shape extends toward the crown and the toe end from the geometric center; the reference shape height is approximately 25% of a total height of the faceplate, measured within the loft plane, in a crown to sole direction; the reference shape width is approximately 25% of a total width of the faceplate, measured perpendicularly to the loft plane, in a heel end to toe end direction; the reference shape further comprises a threshold characteristic time value, and within the reference shape, one or more locations comprise a characteristic time value higher than the threshold characteristic time value; and a first heat affected zone is formed at or near the one or more locations, each heat affected zone location thereafter comprising a characteristic time value lower than or equal to the threshold characteristic time value.

Clause 2. The golf club head of claim 1, wherein the geometric center of the faceplate further defines an origin for a coordinate system having an X' axis and a Y' axis, wherein: the X' axis extends through the geometric center of the faceplate in a direction from the heel to the toe of the club head; the Y' axis extends through the geometric center of the faceplate in a direction from the crown to the sole of the club head and perpendicular to the X' axis to form four faceplate quadrant regions including a center-to-high toe quadrant; and the reference shape is a linear reference shape that extends from the geometric center of the faceplate and bounded in only the center-to-high toe quadrant.

Clause 3. The golf club head of claim 2, wherein the linear reference shape is angled relative to the X' axis between approximately 20 degrees and approximately 80 degrees.

Clause 4. The golf club head of claim 3, wherein the linear reference shape is angled relative to the X' axis between approximately 45 degrees and approximately 50 degrees.

Clause 5. The golf club head of claim 2, wherein along the linear reference shape, at least the first heat affected zone, a second heat affected zone, a third heat affected zone, and a fourth heat affected zone is present and wherein the first, second, third, and fourth heat affected zones have a microstructure different than the microstructure of non-heat affected faceplate regions.

Clause 6. The golf club head of claim 5, wherein the microstructure of the first, second, third, and fourth heat affected zones are needle-like or finger like structures that comprise smaller grain boundaries than the microstructure of non-heat affected faceplate regions.

Clause 7. The golf club head of claim 1, wherein the first heat affected zone covers no more than 16.5% of the external faceplate surface area.

Clause 8. The golf club head of claim 5, wherein the first heat affected zone, the second heat affected zone, the third heat effected zone, and the fourth heat affected zones are substantially co-linear to one another.

Clause 9. The golf club head of claim 8, wherein the first heat affected zone, the second heat affected zone, the third heat effected zone, and the fourth heat affected zones are not present at any location along the faceplate to body transition region.

Clause 10. A golf club head comprising: a faceplate and a body, the body comprising a sole, a crown, a heel end, and a toe end; wherein: the sole is in a ground plane at address; the crown is opposite the sole; the heel end is opposite the toe end and perpendicular to the sole and the crown; the faceplate comprises a geometric center that is equidistant from the crown and the sole, and equidistant from the heel end and the toe end; and the faceplate defines a loft plane, wherein the loft plane intersects the ground plane and is tangent to the geometric center; a reference shape having a height and a width; wherein: the reference shape extends toward the crown and the toe end from the geometric center; the reference shape height is between approximately 5% and approximately 25% of a total height of the faceplate, measured within the loft plane, in a crown to sole direction; the reference shape width is between approximately 5% and approximately 25% of a total width of the faceplate, measured perpendicularly to the loft plane, in a heel end to toe end direction; the reference shape further comprises a threshold characteristic time value, and within the reference shape, one or more locations comprise a characteristic time value higher than the threshold characteristic time value; and a first heat affected zone is formed at or near the one or more locations, each heat affected zone location thereafter comprising a characteristic time value lower than or equal to the threshold characteristic time value.

Clause 11. The golf club head of claim 10, wherein the geometric center of the faceplate further defines an origin for a coordinate system having an X' axis and a Y' axis, wherein: the X' axis extends through the geometric center of the faceplate in a direction from the heel to the toe of the club head; the Y' axis extends through the geometric center of the faceplate in a direction from the crown to the sole of the club head and perpendicular to the X' axis to form four faceplate quadrant regions including a center-to-high toe quadrant; and the reference shape is a linear reference shape that extends from the geometric center of the faceplate and bounded in only the center-to-high toe quadrant.

Clause 12. The golf club head of claim 11, wherein the linear reference shape is angled relative to the X' axis between approximately 20 degrees and approximately 80 degrees.

Clause 13. The golf club head of claim 12, wherein the linear reference shape is angled relative to the X' axis between approximately 45 degrees and approximately 50 degrees.

Clause 14. The golf club head of claim 11, wherein along the linear reference shape, at least the first heat affected zone, a second heat affected zone, a third heat affected zone, and a fourth heat affected zone is present and wherein the first, second, third, and fourth heat affected zones have a microstructure different than the microstructure of non-heat affected faceplate regions.

Clause 15. The golf club head of claim 14, wherein the microstructure of the heat affected zones are needle-like or finger like structures and form smaller grain boundaries than the microstructure of non-heat affected faceplate regions.

Clause 16. The golf club head of claim 10, wherein the first heat affected zone covers no more than 16.5% of the external faceplate surface area.

Clause 17. The golf club head of claim 14, wherein the first heat affected zone, the second heat affected zone, the third heat effected zone, and the fourth heat affected zones are co-linear to one another.

Clause 18. The golf club head of claim 17, wherein the first heat affected zone, the second heat affected zone, the third heat effected zone, and the fourth heat affected zones are not present at any location along the faceplate to body transition region.

Clause 19. The golf club head of 11, wherein the golf club head is a driver-type club head.

Clause 20. The golf club head of claim 11, wherein the golf club head is a driver-type club head with a loft angle less than 10 degrees.

The invention claimed is:

1. A golf club head comprising:

a faceplate and a body, the body comprising a sole, a crown, a heel end, and a toe end; wherein:
- the sole is in a ground plane at address;
- the crown is opposite the sole;
- the heel end is opposite the toe end and perpendicular to the sole and the crown;

the faceplate comprises a geometric center that is equidistant from the crown and the sole, and equidistant from the heel end and the toe end; and the faceplate defines a loft plane, wherein the loft plane intersects the ground plane and is tangent to the geometric center;

the faceplate further comprises a region defined by a reference shape having a height and a width; wherein:

the reference shape extends toward the crown and the toe end from the geometric center;

a reference shape height is approximately 25% of a total height of the faceplate, measured within the loft plane, in a crown-to-sole direction;

a reference shape width is approximately 25% of a total width of the faceplate, measured perpendicularly to the loft plane, in a heel end-to-toe end direction;

the reference shape further comprises a threshold characteristic time value, and within the reference shape, one or more locations comprise a characteristic time value; and the faceplate further comprises a first heat affected zone at or near the one or more locations, each heat affected zone location comprising a characteristic time value, wherein;

the first heat affected zone comprises a spot weld comprising a diameter less than approximately 0.75 inch, and the first heat affected zone comprises a diameter less than approximately 50% of the diameter of the spot weld; and a physical grain structure of the first heat affected zone is a dendrite microstructure.

2. The golf club head of claim 1, wherein the geometric center of the faceplate further defines an origin for a coordinate system having an X' axis and a Y' axis, wherein:

the X' axis extends through the geometric center of the faceplate in a direction from the heel end to the toe end of the golf club head;

the Y' axis extends through the geometric center of the faceplate in a direction from the crown to the sole of the golf club head and perpendicular to the X' axis to form four faceplate quadrant regions including a center-to-high toe quadrant; and the reference shape is a linear reference shape that extends from the geometric center of the faceplate and bounded in only the center-to-high toe quadrant.

3. The golf club head of claim 2, wherein the linear reference shape is angled relative to the X' axis between approximately 20 degrees and approximately 80 degrees.

4. The golf club head of claim 3, wherein the linear reference shape is angled relative to the X' axis between approximately 45 degrees and approximately 50 degrees.

5. The golf club head of claim 2, wherein along the linear reference shape, at least the first heat affected zone, a second heat affected zone, a third heat affected zone, and a fourth heat affected zone is present and wherein the first, second, third, and fourth heat affected zones have a microstructure different than the microstructure of non-heat affected faceplate regions.

6. The golf club head of claim 5, wherein the microstructure of the first, second, third, and fourth heat affected zones are needle-like or finger like structures that comprise smaller grain boundaries than the microstructure of non-heat affected faceplate regions.

7. The golf club head of claim 1, wherein the first heat affected zone covers no more than 16.5% of an external faceplate surface area.

8. The golf club head of claim 5, wherein the first heat affected zone, the second heat affected zone, the third heat affected zone, and the fourth heat affected zone are substantially co-linear to one another.

9. The golf club head of claim 8, wherein the first heat affected zone, the second heat affected zone, the third heat affected zone, and the fourth heat affected zones are not present at any location along the faceplate to body transition region.

10. A golf club head comprising:

a faceplate and a body, the body comprising a sole, a crown, a heel end, and a toe end; wherein:

the sole is in a ground plane at address;

the crown is opposite the sole;

the heel end is opposite the toe end and perpendicular to the sole and the crown;

the faceplate comprises a geometric center that is equidistant from the crown and the sole, and equidistant from the heel end and the toe end; and the faceplate defines a loft plane, wherein the loft plane intersects the ground plane and is tangent to the geometric center;

the faceplate comprises a region defined by a reference shape having a height and a width; wherein:

the reference shape extends toward the crown and the toe end from the geometric center;

a reference shape height is between approximately 5% and approximately 50% of a total height of the faceplate, measured within the loft plane, in a crown-to-sole direction;

a reference shape width is between approximately 5% and approximately 50% of a total width of the faceplate, measured perpendicularly to the loft plane, in a heel end-to-toe end direction;

the reference shape further comprises a threshold characteristic time value, and within the reference shape, one or more locations comprise a characteristic time value; and a first heat affected zone at or near the one or more locations, each heat affected zone location comprising a characteristic time value;

the first heat affected zone comprises a spot weld comprising a diameter less than approximately 0.75 inch, and the first heat affected zone comprises a diameter less than approximately 50% of the diameter of the spot weld; and a physical grain structure of the first heat affected zone is a dendrite microstructure.

11. The golf club head of claim 10, wherein the geometric center of the faceplate further defines an origin for a coordinate system having an X' axis and a Y' axis, wherein:

the X' axis extends through the geometric center of the faceplate in a direction from the heel end to the toe end of the golf club head;

the Y' axis extends through the geometric center of the faceplate in a direction from the crown to the sole of the golf club head and perpendicular to the X' axis to form four faceplate quadrant regions including a center-to-high toe quadrant; and the reference shape is a linear reference shape that extends from the geometric center of the faceplate and bounded in only the center-to-high toe quadrant.

12. The golf club head of claim 11, wherein the linear reference shape is angled relative to the X' axis between approximately 20 degrees and approximately 80 degrees.

13. The golf club head of claim 12, wherein the linear reference shape is angled relative to the X' axis between approximately 45 degrees and approximately 50 degrees.

14. The golf club head of claim 11, wherein along the linear reference shape, at least the first heat affected zone, a second heat affected zone, a third heat affected zone, and a fourth heat affected zone is present and wherein the first, second, third, and fourth heat affected zones have a microstructure different than the microstructure of non-heat affected faceplate regions.

15. The golf club head of claim 14, wherein the microstructure of the heat affected zones are needle-like or finger like structures and form smaller grain boundaries than the microstructure of non-heat affected faceplate regions.

16. The golf club head of claim 10, wherein the first heat affected zone covers no more than 16.5% of an external faceplate surface area.

17. The golf club head of claim 14, wherein the first heat affected zone, the second heat affected zone, the third heat affected zone, and the fourth heat affected zones are colinear to one another.

18. The golf club head of claim 17, wherein the first heat affected zone, the second heat affected zone, the third heat affected zone, and the fourth heat affected zones are not present at any location along the faceplate to body transition region.

19. The golf club head of claim 10, wherein the spot weld comprises a diameter less than approximately 0.70 inch, and the first heat affected zone comprises a diameter less than approximately 45% of the diameter of the spot weld.

20. The golf club head of claim 10, wherein the spot weld comprises a diameter less than approximately 0.65 inch, and the first heat affected zone comprises a diameter less than approximately 40% of the diameter of the spot weld.

* * * * *